US009396923B2

(12) United States Patent
Kodera et al.

(10) Patent No.: US 9,396,923 B2
(45) Date of Patent: Jul. 19, 2016

(54) ION SELECTION METHOD IN ION TRAP AND ION TRAP SYSTEM

(71) Applicant: SHIMADZU CORPORATION, Kyoto-shi, Kyoto (JP)

(72) Inventors: Kei Kodera, Kyoto (JP); Makoto Hazama, Takarazuka (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/427,016

(22) PCT Filed: Sep. 6, 2013

(86) PCT No.: PCT/JP2013/074134
§ 371 (c)(1),
(2) Date: Mar. 10, 2015

(87) PCT Pub. No.: WO2014/038672
PCT Pub. Date: Mar. 13, 2014

(65) Prior Publication Data

US 2015/0255263 A1 Sep. 10, 2015

(30) Foreign Application Priority Data

Sep. 10, 2012 (JP) ..... 2012-198396

(51) Int. Cl.
*H01J 49/42* (2006.01)
*H01J 49/44* (2006.01)

(52) U.S. Cl.
CPC ..... *H01J 49/424* (2013.01); *H01J 49/427* (2013.01); *H01J 49/4285* (2013.01)

(58) Field of Classification Search
USPC ..... 250/482, 292, 290, 281, 283, 289, 293, 250/297, 282
See application file for complete search history.

(56) References Cited

U.S. PATENT DOCUMENTS 4,818,869 A 4/1989 Weber-Grabau
5,134,286 A 7/1992 Kelley
5,173,604 A * 12/1992 Kelley ..... H01J 49/4285 250/282

(Continued)

FOREIGN PATENT DOCUMENTS

EP 0 362 432 A1 4/1990
JP 2006-526876 A 11/2006

(Continued)

OTHER PUBLICATIONS

Osamu Furuhashi, et al., "Development of Digital Ion Trap Mass Spectrometer", Shimadzu Hyouron (Shimadzu Review), Shimadzu Hyouron Henshuubu, Mar. 31, 2006, pp. 141-151, vol. 62, Nos. 3-4, Cited in the Specification on pp. 2-4, 6 and 36.

(Continued)

*Primary Examiner* — David A Vanore
(74) *Attorney, Agent, or Firm* — Sughrue Mion, PLLC

(57) ABSTRACT

Provided is an ion selection method capable of isolating and leaving a target ion in an ion trap within a short period of time and with high separating power. In a digital ion trap, after ions over a wide range of m/z near a target ion are selectively retained by rough isolation using an FNF signal or the like (S11), unnecessary ions on a low-mass side are removed with high separating power by changing the duty ratio of a rectangular voltage (S12). Furthermore, unnecessary ions on a high-mass side are removed with high separating power by resonant excitation discharge (S13).

9 Claims, 10 Drawing Sheets

(56) References Cited

U.S. PATENT DOCUMENTS 5,198,665 A * 3/1993 Wells ..... H01J 49/424 250/281
5,302,826 A * 4/1994 Wells ..... H01J 49/424 250/282
5,438,195 A * 8/1995 Franzen ..... H01J 49/4285 250/282
5,468,957 A * 11/1995 Franzen ..... H01J 49/427 250/282
5,528,031 A * 6/1996 Franzen ..... H01J 49/424 250/282
5,625,186 A * 4/1997 Frankevich ..... H01J 49/027 250/282
5,710,427 A * 1/1998 Schubert ..... H01J 49/424 250/282
5,793,038 A * 8/1998 Buttrill, Jr. ..... H01J 49/428 250/282
6,124,592 A * 9/2000 Spangler ..... G01N 27/624 250/282
6,452,168 B1 * 9/2002 McLuckey ..... H01J 49/38 250/282
6,545,268 B1 * 4/2003 Verentchikov ..... H01J 49/004 250/281
7,456,396 B2 * 11/2008 Quarmby ..... H01J 49/427 250/282
8,022,358 B2 * 9/2011 Green ..... H01J 49/4235 250/282
8,030,612 B2 * 10/2011 Collings ..... H01J 49/427 250/288
8,237,109 B2 * 8/2012 Guna ..... H01J 49/005 250/281
8,933,397 B1 * 1/2015 Hanson ..... H01J 49/42 250/287
2004/0079875 A1 * 4/2004 Ding ..... H01J 49/427 250/282
2005/0263696 A1 * 12/2005 Wells ..... H01J 49/423 250/292
2006/0289738 A1 * 12/2006 Brekenfeld ..... H01J 49/424 250/282
2007/0084994 A1 * 4/2007 Wang ..... H01J 49/424 250/282
2008/0093546 A1 * 4/2008 Hartmer ..... H01J 49/145 250/282
2009/0032698 A1 * 2/2009 Furuhashi ..... H01J 49/0063 250/282
2009/0127453 A1 * 5/2009 Ding ..... H01J 49/0072 250/282
2012/0049059 A1 * 3/2012 Taniguchi ..... H01J 49/428 250/290
2012/0292499 A1 * 11/2012 Taniguchi ..... H01J 49/424 250/286
2015/0303047 A1 * 10/2015 Jiang ..... H01J 49/4225 250/283

FOREIGN PATENT DOCUMENTS

JP 2007-527002 A 9/2007
JP 2008-510290 A 4/2008
WO 2004/109743 A2 12/2004
WO 2005/083743 A2 9/2005
WO 2006/023252 A2 3/2006

OTHER PUBLICATIONS

Francesco L. Brancia, et al., "Digital Asymmetric Waveform Isolation (DAWI) in a Digital Linear Ion Trap", Journal of American Society for Mass Spectrometry, 2010, pp. 1530-1533, vol. 21.
International Search Report for PCT/JP2013/074134 dated Oct. 1, 2013 [PCT/ISA/210].
Communication dated Sep. 15, 2015 from the Japanese Patent Office in counterpart application No. 2014-534423.
Communication dated Aug. 20, 2015 from the European Patent Office in counterpart application No. 13834797.6.

* cited by examiner (a)

(b)

(a)

(b)

ION SELECTION METHOD IN ION TRAP AND ION TRAP SYSTEM

CROSS REFERENCE TO RELATED APPLICATIONS

This application is a National Stage of International Application No. PCT/JP2013/074134, filed on Sep. 6, 2013, which claims priority from Japanese Patent Application No. 2012-198396, filed on Sep. 10, 2012, the contents of all of which are incorporated herein by reference in their entirety.

TECHNICAL FIELD

The present invention relates to an ion selection method for selectively leaving a specific kind of ion within an ion trap which captures ions by an effect of a radio-frequency electric field, as well as an ion trap system for carrying out this ion selection method. For example, the ion trap system can be used in an ion-trap time-of-flight mass spectrometer in which the ion trap system is combined with a time-of-flight mass spectrometer or an ion-trap mass spectrometer which performs mass spectrometry using the mass-separating function of the ion trap itself.

BACKGROUND ART

In an ion-trap time-of-flight mass spectrometer, ion-trap mass spectrometer or similar system, an ion trap is used to capture and confine ions by an effect of a radio-frequency electric field, to select an ion having a specific mass to-charge ratio m/z, and/or to break the thus selected ion into fragments. A typical example of the ion trap has a three-dimensional quadrupole configuration which consists of one ring electrode having an inner surface shaped like a hyperboloid of revolution of one sheet and a pair of end-cap electrodes having an inner surface shaped like a hyperboloid of revolution of two sheets facing each other across the ring electrode. Another commonly known example is a linear configuration consisting of four rod electrodes arranged parallel to each other. For convenience, the present description will hereinafter take the three-dimensional quadrupole ion trap as an example without specifically noting so. However, as will be explained later, the present invention can also be applied in a linear ion trap.

In the conventionally and commonly used type of ion trap, or the so-called analogue drive ion trap (which is hereinafter abbreviated as "AIT (analogue ion trap)" to clearly distinguish it from a DIT which will be mentioned later), a sinusoidal radio-frequency voltage is applied to the ring electrode to create an ion-capturing radio-frequency electric field within the space surrounded by the ring electrode and the end-cap electrodes and confine ions while oscillating them within that space by the effect of the radio-frequency electric field. Meanwhile, an ion trap which confines ions by applying a rectangular radio-frequency voltage to the ring electrode in place of the sinusoidal radio-frequency electric field has been developed in recent years (for example, see Patent Literature 1 or Non Patent Literature 1). This type of ion trap is normally called a digital ion trap (which is hereinafter abbreviated as DIT) since it uses a rectangular voltage having the binary voltage levels of "high" and "low."

When an MS/MS analysis is performed in a mass spectrometer using a DIT (which is hereinafter abbreviated as the "DIT-MS"), after ions having a predetermined range of mass-to-charge ratios are captured within the inner space of the ion trap, a precursor-isolating (selecting) operation for discharging unnecessary ions from the ion trap must be performed so as to leave only an ion having a specific mass-to-charge ratio. For example, in the DIT-MS disclosed in Non Patent Literature 1, a precursor isolation using a high-speed technique called the rough isolation is initially performed, after which another precursor isolation with a higher level of resolving power is performed using a resonant excitation discharge by dipole excitation.

The rough isolation is a technique in which the precursor isolation is achieved by varying the applied voltage so as to shift the position of a line traversing a stability region on a stability diagram, which is prepared based on the stability condition for the solution of a Mathieu equation, and thereby change the lower limit mass (LMCO=low mass cut off) and the upper limit mass (HMCO=high mass cut off) of the ions that can be captured. Patent Literature 2 discloses an application of such a technique in an AIT. In a technique called DAWI (digital asymmetric waveform isolation) in Non Patent Literature 1 mentioned earlier as well as in Non Patent Literature 2, the duty ratio of the rectangular voltage is varied to change the LMCO and HMCO and thereby achieve by the precursor isolation.

One advantage of the DIT over the AIT is the high mass-separating power achieved by resonant excitation discharge. Normally, when the resonant excitation discharge is performed in a DIT, a rectangular-wave signal having a single frequency synchronized with the frequency of the rectangular voltage applied to the ring electrode is applied to the pair of end-cap electrodes (the single frequency is typically obtained by dividing the frequency of the aforementioned rectangular voltage). In this state, when the angular frequency of the rectangular voltage applied to the ring electrode is continuously decreased, the ions captured in the ion trap are sequentially and selectively subjected to resonant excitation in ascending order of their mass-to-charge ratios and discharged from the ion trap (forward scan). Conversely, when the frequency of the rectangular voltage applied to the ring electrode is continuously increased, the ions captured within the ion trap are sequentially and selectively subjected to resonant excitation in descending order of their mass-to-charge ratios and discharged from the ion trap (reverse scan). Accordingly, it is possible to achieve a high level of precursor-isolation power by successively performing the forward scan and the reverse scan by dipole excitation so as to leave only an ion having a desired mass-to-charge ratio within the ion trap.

However, there is the problem that a considerable amount of time is required if a method like the one described in Non Patent Literature 1 is used for the precursor isolation of a specific ion with high mass-separating power. This is due to the fact that, to assuredly remove unnecessary ions by the forward and backward scans, it is necessary to maintain the frequency for a predetermined discharge time for each unnecessary ion, and therefore, the rate of continuously changing the frequency must be decreased to a certain level or lower.

In a typical case, to achieve a sufficient mass-separating power, a period of time equal to or longer than several hundreds of milliseconds is required for only the precursor isolation. For example, in the DIT-MS in which the mass separation is performed in the ion trap itself, the MS/MS analysis is normally performed by the steps of: (A) capturing ions within a predetermined range of mass-to-charge ratios in the ion trap and cooling them; (B) performing an ion selection (the previously described precursor isolation) so as to leave only a desired precursor ion within the ion trap; (C) fragmenting the precursor ion by collision induced dissociation; and (D) causing a resonant discharge of the product ions produced by the fragmentation and obtaining a mass spectrum. Among these processes, each of the processes (A), (C) and (D) only requires a few to several tens of milliseconds. Accordingly, consuming several hundreds of milliseconds for only process (B) will significantly lower the throughput of the analysis. In recent years, improving the throughput of an analysis has been extremely important in the field of mass spectrometry, and time reduction of the precursor isolation in the DIT is a critical and unavoidable problem.

Methods for performing precursor isolation in an ion trap are not limited to the previously described ones; some other techniques are also commonly known. For example, for AITs, a precursor isolation technique has been commonly known which uses the relationship that the oscillation frequency of ions changes depending on the amplitude of the radio-frequency voltage applied to the ring electrode. In this technique, various kinds of unnecessary ions other than the target ion (precursor ion) are simultaneously removed by applying to the end-cap electrodes a signal having a broad-band frequency spectrum with a notch (omission) at the oscillation frequency of the target ion. One example of the signals commonly used as the aforementioned broad-band signal is an FNF (filtered noise field) signal described in Patent Literature 3. Another known example is a SWIFT (stored wave inverse Fourier transform) signal described in Patent Literature 4.

The techniques described in those literatures are intended for use in the AIT. However, the DIT also allows the use of an FNF signal or similar broad-band signal to achieve precursor isolation as in the case of the AIT. For example, Patent Literature 3 discloses a specific technique and system configuration for applying the precursor isolation using an FNF signal in the DIT. Although such a precursor isolation technique can be used as the aforementioned rough isolation, it is difficult to use this technique as the high-resolution precursor isolation which follows the rough isolation, since its resolving power is insufficient.

CITATION LIST

Patent Literature

Patent Literature 1: JP 2007-527002 A
Patent Literature 2: U.S. Pat. No. 4,818,869 B
Patent Literature 3: U.S. Pat. No. 5,134,286 B
Patent Literature 4: EP 0362432 A

Non Patent Literature

Non Patent Literature 1: Furuhashi et al., "Dejitaru Ion Torappu Shitsuryou Bunseki Souchi No Kaihatsu (Development of Digital Ion Trap Mass Spectrometer)", *Shimadzu Hyouron* (*Shimadzu Review*), Shimadzu Hyouron Henshuubu, Mar. 31, 2006, Vol. 62, Nos. 3•4, pp. 141-151

Non Patent Literature 2: F. L. Brancia et al., "Digital Asymmetric Waveform Isolation (DAWI) in a Digital Linear Ion Trap", *Journal of American Society for Mass Spectrometry*, 2010, 21, pp. 1530-1533

SUMMARY OF INVENTION

Technical Problem

The present invention has been developed to solve the previously described problem, and its objective is to provide an ion selection method in an ion trap which can reduce the amount of time for selecting a precursor ion or other kinds of ions while ensuring a high level of mass-separating power in the ion selection, as well as to provide such an ion trap system.

Solution to Problem

The first mode of the ion selection method according to the present invention aimed at solving the previously described problem is an ion selection method for selecting an ion having a specific mass-to-charge ratio or an ion group having a specific range of mass-to-charge ratios from among ions captured in an ion trap composed of three or more electrodes, the method including:

a) a low-mass side ion isolation step, in which unnecessary ions having mass-to-charge ratios lower than the specific mass-to-charge ratio or the specific range of mass-to-charge ratios to be selected are removed by performing, on the ions captured in the ion trap, an ion-discharging operation in which a portion of the ions are discharged by shifting the position of a working line on a stability diagram based on a Mathieu equation and thereby changing the lower limit mass that can be captured; and b) a high-mass side ion isolation step, in which unnecessary ions having mass-to-charge ratios higher than the specific mass-to-charge ratio or the specific range of mass-to-charge ratios to be selected are removed by performing, on the ions captured in the ion trap, an ion-discharging operation in which a portion of the ions are discharged by using a resonant excitation, where the two steps are performed in this order, in the reverse order or simultaneously.

The second mode of the ion selection method according to the present invention aimed at solving the previously described problem is an ion selection method for selecting an ion having a specific mass-to-charge ratio or an ion group having a specific range of mass-to-charge ratios from among ions captured in an ion trap composed of three or more electrodes, the method including:

a) a low-mass side ion isolation step, in which unnecessary ions having mass-to-charge ratios lower than the specific mass-to-charge ratio or the specific range of mass-to-charge ratios to be selected are removed by performing, on the ions captured in the ion trap, an ion-discharging operation in which a portion of the ions are discharged by using a resonant excitation for oscillating the ions in a first direction; and b) a high-mass side ion isolation step, in which unnecessary ions having mass-to-charge ratios higher than the specific mass-to-charge ratio or the specific range of mass-to-charge ratios to be selected are removed by performing, on the ions captured in the ion trap, an ion-discharging operation in which a portion of the ions are discharged by using a resonant excitation for oscillating the ions in a second direction different from the first direction, where the two steps are performed in this order, in the reverse order or simultaneously.

The first mode of the ion trap system according to the present invention aimed at solving the previously described problem is an ion trap system having three or more electrodes for carrying out the first mode of the ion selection method, the system including:

a) a voltage generator for applying a predetermined voltage to each of the three or more electrodes; and b) a controller for controlling the voltage generated by the voltage generator so as to perform two ion-discharging operations when various kinds of ions are captured in an ion trap, the two ion-discharging operations including: an ion-discharging operation in which a portion of the ions are discharged by shifting the position of a working line on a stability diagram based on a Mathieu equation and thereby changing the lower limit mass that can be captured, so as to remove unnecessary ions having mass-to-charge ratios lower than a specific mass-to-charge ratio or a specific range of mass-to-charge ratios to be selected; and an ion-discharging operation in which a portion of ions are discharged by using a resonant excitation so as to remove unnecessary ions having mass-to-charge ratios higher than the specific mass-to-charge ratio or the specific range of mass-to-charge ratios to be selected, where the two ion-discharging operations are performed in this order, in the reverse order or simultaneously.

The second mode of the ion trap system according to the present invention aimed at solving the previously described problem is an ion trap system having three or more electrodes for carrying out the second mode of the ion selection method, the system including:

a) a voltage generator for applying a predetermined voltage to each of the three or more electrodes; and b) a controller for controlling the voltage generated by the voltage generator so as to perform two ion-discharging operations when various kinds of ions are captured in an ion trap, the two ion-discharging operations including: an ion-discharging operation for discharging a portion of the ions by using a resonant excitation for oscillating the ions in a first direction so as to remove unnecessary ions having mass-to-charge ratios lower than a specific mass-to-charge ratio or a specific range of mass-to-charge ratios to be selected; and an ion-discharging operation for discharging a portion of the ions by using a resonant excitation for oscillating the ions in a second direction different from the first direction so as to remove unnecessary ions having mass-to-charge ratios higher than the specific mass-to-charge ratio or the specific range of mass-to-charge ratios to be selected, where the two ion-discharging operations are performed in this order, in the reverse order or simultaneously.

In the first and second modes of the ion selection method, it is preferable to perform, in advance of the low-mass side ion isolation step and the high-mass side ion isolation step:

a rough isolation step in which ions having a wide range of mass-to-charge ratios including the specific mass-to-charge ratio or the specific range of mass-to-charge ratios to be selected are selectively left within the ion trap while other unnecessary ions are removed, after which the low-mass side ion isolation step in which ions having mass-to-charge ratios lower than the specific mass-to-charge ratio or the specific range of mass-to-charge ratios to be selected are removed with a separating power higher than in the rough isolation step, and the high-mass side ion isolation step in which ions having mass-to-charge ratios higher than the specific mass-to-charge ratio or the specific range of mass-to-charge ratios to be selected are removed with a separating power higher than in the rough isolation step, are performed on the ions remaining after ion selection by the rough isolation step.

In the first and second modes of the ion trap system, the controller may preferably be configured to control the voltage generated by the voltage generator so as to perform a rough isolation in which ions having a wide range of mass-to-charge ratios including a specific mass-to-charge ratio or a specific range of mass-to-charge ratios to be selected are selectively left within the ion trap while other unnecessary ions are removed, and to subsequently remove, from the ions remaining after the ion selection by the rough isolation, ions having mass-to-charge ratios lower than the specific mass-to-charge ratio or the specific range of mass-to-charge ratios to be selected, with a separating power higher than in the rough isolation, as well as to remove ions having mass-to-charge ratios higher than the specific mass-to-charge ratio or the specific range of mass-to-charge ratios to be selected, with a separating power higher than in the rough isolation.

There is no specific limitation on the method for the rough isolation. For example, the previously mentioned techniques can be used, such as the technique using an FNF signal, the technique using a SWIFT signal, and the technique using DAWI described in Non Patent Literature 2. From the viewpoint of completing the ion selection as quickly as possible, it is preferable to use a technique which may have a low level of separating power but requires only a short period of time to remove unnecessary ions over a wide range of mass-to-charge ratios.

An ion trap system in which the first and second modes of the ion selection method according to the present invention are carried out, as well as the first and second modes of the ion trap system according to the present invention, may be either a three-dimensional quadrupole ion trap or a linear ion trap. As already explained, a three-dimensional quadrupole ion trap is composed of three electrodes including a ring electrode and a pair of end-cap electrodes facing each other across the ring electrode. On the other hand, a linear ion trap is composed of four rod electrodes arranged parallel to each other so as to surround a central axis.

In an ion trap system in which the first and second modes of the ion selection method according to the present invention are carried out, as well as in the first and second modes of the ion trap system according to the present invention, the voltage applied to each electrode in the ion selection process is an alternating voltage. The waveform of this voltage may be either a sinusoidal waveform or a pulse waveform, such as a rectangular wave. That is to say, the ion trap system may be either the AIT or the DIT described earlier. In particular, the rectangular voltage can be generated by alternately selecting two different voltage levels using a switching element, and therefore, allows its frequency to be easily switched by changing the operating frequency of the switching element. Its duty ratio can also be easily switched by changing the timing of switching the voltage while maintaining the operating frequency of the switching element. Accordingly, in the case of conducting a control which includes changing the frequency and/or duty ratio of the alternating voltage applied to the electrodes, the DIT which uses a rectangular voltage as the alternating voltage is more convenient.

In the first mode of the ion selection method and the ion trap system according to the present invention, the "ion-discharging operation in which a portion of the ions are discharged by shifting the position of a working line on a stability diagram based on a Mathieu equation and thereby changing the lower limit mass that can be captured" is, for example, the DAWI described in Non Patent Literature 2 or the technique described in Patent Literature 2. Specifically, for example, in the DIT, the position of the working line can be shifted by changing the duty ratio of the rectangular voltage applied to the electrodes. It is also possible to shift the position of the working line by giving a direct bias voltage to the rectangular voltage and thereby causing an offset. This operation is also applicable in the AIT, in which case the position of the working line can be shifted by giving a direct bias voltage to the sinusoidal voltage and thereby causing an offset.

On the stability diagram based on the Mathieu equation, in the vicinity of the point of intersection between the working line and the stability-region boundary line corresponding to the lower limit mass that can be captured (LMCO), the pseudo-potential well formed by the capturing electric field is adequately deep and the well depth does not significantly change with a shift of the working point. Therefore, the lower limit mass mainly depends on the oscillation amplitude of the ions within the ion trap and does not significantly vary. By contrast, in the vicinity of the point of intersection between the working line and the stability-region boundary line corresponding to the upper limit mass that can be captured (LMCO) on the stability diagram, the pseudo-potential well formed by the capturing electric field is considerably shallow, and furthermore, the well depth significantly changes with a shift of the working point. Therefore, the upper limit mass significantly varies. From these facts, it can be said that, in the operation of discharging ions by shifting the position of the working line on the stability diagram based on the Mathieu equation, adequately high separating power can be achieved when removing unnecessary ions whose masses are lower than the target mass-to-charge ratio or the target range of mass-to-charge ratios to be selected, while the separating power is low when removing unnecessary ions whose masses are higher than the target mass-to-charge ratio or the target range of mass-to-charge ratios.

Accordingly, in the first mode of the ion selection method and the ion trap system, an ion-discharging operation in which the position of the working line on the stability diagram based on the Mathieu equation is shifted, as in DAWI, is performed so as to remove unnecessary ions having mass-to-charge ratios lower than the specific mass-to-charge ratio or the specific range of mass-to-charge ratios to be selected. By this ion-discharging operation, a wide variety of ions can be simultaneously discharged, so that adequately high separating power can be achieved on the low-mass side, as explained previously, even within a short period of time.

On the other hand, the separating power achieved on the high-mass side by this method is low. Therefore, an ion-discharging operation using a resonant excitation is performed simultaneously with, before, or after the previously described ion-discharging operation so as to remove unnecessary ions having mass-to-charge ratios higher than the specific mass-to-charge ratio or the specific range of mass-to-charge ratios to be selected.

The herein used resonant excitation discharge may be either the dipole excitation, in which voltages of opposite polarities are applied to a pair of mutually facing electrodes among the three or more electrodes to cause excitation in a single direction, or the quadrupole excitation, in which the excitation can be caused in two mutually orthogonal directions by selectively applying either voltages of opposite polarities or voltages of the same polarity to a pair of electrodes which, for example, face each other, although the quadrupole excitation is more desirable. In the resonant excitation discharge by quadrupole excitation, an extremely clear boundary appears between the mass-to-charge ratios of the ions to be discharged and those of the ions to be retained within the ion trap without being discharged, particularly when the excitation is performed with a single frequency. This clarity is maintained even if the excitation voltage itself is increased to expand the range of mass-to-charge ratios to be discharged. Therefore, by performing a single-frequency quadrupole excitation, it is possible to remove ions over a certain wide range of mass-to-charge ratios with high separating power (e.g. with a separating power of approximately 1 Da).

Thus, in the first mode of the ion selection method and the ion trap system according to the present invention, different techniques for removing unnecessary ions are used on the lower and higher sides of the specific mass-to-charge ratio or the specific range of mass-to-charge ratios to be selected, and those techniques are chosen so that high separating power can be achieved on both sides. Therefore, it is possible to leave only the target ion or ion group within the ion trap with high separating power. In particular, when the rough isolation is performed beforehand in the previously described manner, the range of mass-to-charge ratios within which unnecessary ions must be removed with high separating power will be limited, which has the effect of reducing the time required for the previously described high-separation ion-discharging operation and decreasing the amount of time for the ion selection. Using a single-frequency quadrupole excitation to remove ions on the side higher than the specific mass-to-charge ratio or the specific range of mass-to-charge ratios to be selected is particularly advantageous in that the ions remaining over a certain wide range of mass-to-charge ratios after the rough isolation can be removed with high separating power, without requiring a frequency scan and hence in an extremely short period of time.

In the second mode of the ion selection method and the ion trap system according to the present invention, ions are removed by resonant excitation on the lower side as well as on the higher side of the specific mass-to-charge ratio or the specific range of mass-to-charge ratios to be selected, where the two resonant excitations are made to differ from each other in the direction of ion oscillation. As already explained, the quadrupole excitation allows the excitation to be selectively performed between two mutually orthogonal directions. Therefore, for example, it is possible to use the quadrupole excitation for both the low-mass side ion isolation and the high-mass side ion isolation and to set the applied voltages so that the ion oscillation will occur in a different axial direction in each of these cases. Although either the low-mass side ion isolation or the high-mass side ion isolation can be performed by dipole excitation, the quadrupole excitation is more preferable than the dipole excitation for the previously described reasons, i.e. because of its wider range of mass-to-charge ratios that can be removed and its higher level of mass-separating power.

When the resonant excitation discharges are performed in this manner with the direction of ion oscillation being different between the low-mass side and the high-mass side, the two resonances independently occur and cause almost no influence on each other even if the two resonant excitations are simultaneously performed, i.e. even if a plurality of voltages superposed on each other for simultaneously causing the two resonant excitations are applied to the electrodes. By this operation, a high level of separating power is achieved while the amount of time required for the resonant excitation discharge is decreased. Furthermore, similarly to the first mode of the present invention, when the rough isolation is performed beforehand in the previously described manner, the range of mass-to-charge ratios within which unnecessary ions must be removed with high separating power will be limited, which has the effect of reducing the time required for the previously described high-separation ion-discharging operation and decreasing the amount of time for the ion selection.

Advantageous Effects of the Invention

With the ion selection method and the ion trap system according to the present invention, it is possible to conduct an ion selection process, such as precursor isolation, so as to leave a target ion or ion group within an ion trap with high resolving power and in a short period of time. As a result, for example, the throughput of an $MS^n$ analysis can be improved in a mass spectrometer using an ion trap.

DESCRIPTION OF EMBODIMENTS

First Ion-Selection Method

Figure 2:
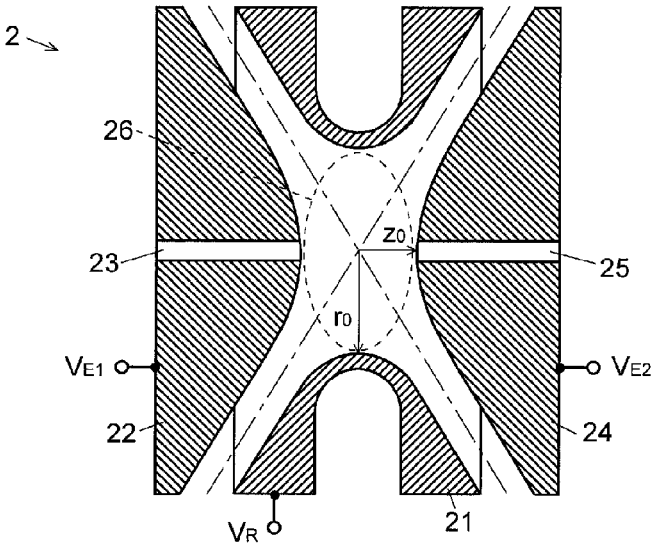
FIG. 2 is a configuration diagram of a three-dimensional quadrupole ion trap.

Initially, one technique of the ion selection method according to the present invention is described with reference to the drawings. It is hereinafter assumed that a three-dimensional quadrupole ion trap 2 as shown in FIG. 2 is used as the ion trap. That is to say, this ion trap 2 includes a ring electrode 21 and a pair of end-cap electrodes 22 and 24 arranged to face each other across the ring electrode 21. The two end-cap electrodes 22 and 24 have, at their respective centers, an ion injection hole 23 and an ion ejection hole 25, both holes approximately lying on the same straight line. This straight line passing through the centers of the ion injection hole 23 and the ion ejection hole 25 is the z axis of the ion trap 2. An axis which is perpendicular to the z axis and which extends in the radial direction of the ring electrode 21 is the r axis of the ion trap 2.

Figure 5:
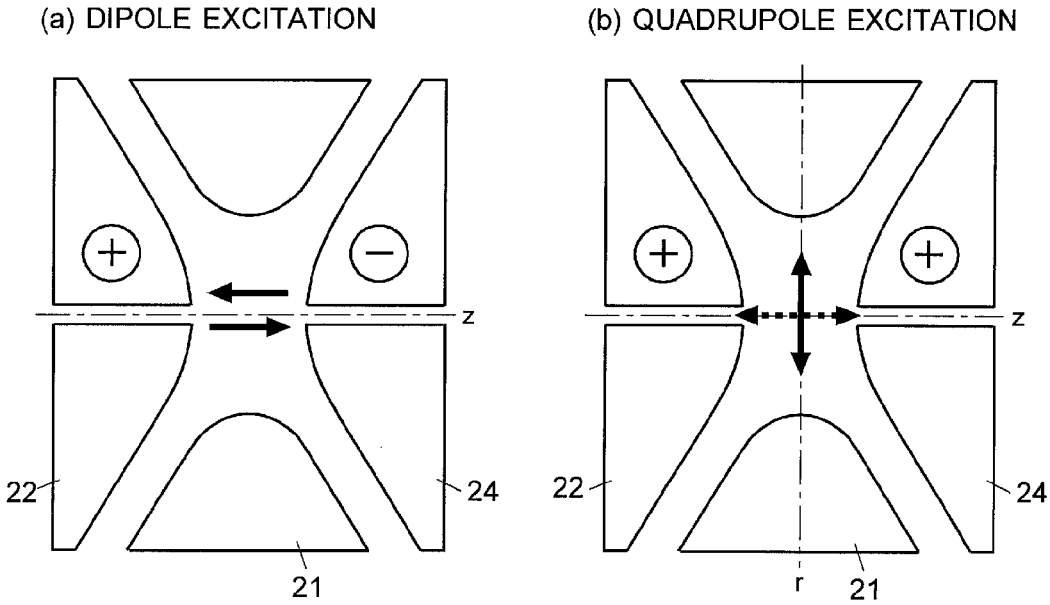
FIG. 5 is a model diagram for explaining the behavior of ions in a dipole excitation and in a quadrupole excitation.

As is generally known, in such an ion trap 2, it is possible to promote, by resonant excitation, the oscillation of ions captured within the space surrounded by the electrodes 21, 22 and 24, i.e. to amplify their oscillation, so as to discharge them from the ion trap 2. As shown in FIG. 5, the primary examples of the resonant excitation are the dipole excitation and the quadrupole excitation.

In the dipole excitation, the angular frequency Ω of the excitation is expressed by the following equation (1):

$$\Omega=(1/2)\beta_i\omega,\ \{n\pm(1/2)\beta_i\}\omega\ n=1,2,\ldots,\infty \tag{1}$$

where ω is the angular frequency of the radio-frequency voltage capturing an ion (i.e. the voltage applied to the ring electrode 21) and i indicates the direction of the motion of the ion. In a three-dimensional quadrupole ion trap as shown in FIG. 2, the parameter i can indicate two directions, i.e. the z-axis direction which indicates the direction of the axis of symmetry, and the r axis direction which indicates the radial direction. In a linear ion trap, this parameter can indicate two directions perpendicular to the axis of symmetry, i.e. the x-axis direction and the y-axis direction. Parameter β, which represents the motion of an ion, is determined by the mass of the ion, the amplitude and the frequency of the radio-frequency voltage applied to the ion trap, the direct voltage as well as the distance between the electrodes.

Using the angular frequency Ω of the excitation, the frequency f of the excitation waves can be expressed as $f=\Omega/2\pi$. In the case of performing a resonant excitation by dipole excitation, an excitation voltage having a frequency calculated by equation (1) for an ion to be excited is applied, with opposite polarities, to a pair of electrodes. Specifically, as shown in diagram (a) in FIG. 5, alternating voltages (which may be either sinusoidal or rectangular waves) of opposite polarities are applied to the pair of end-cap electrodes 22 and 24 facing each other. This operation causes the captured ion to oscillate in a single-axis direction along the z axis, as shown in diagram (a) in FIG. 5. This means that, in a three-dimensional quadrupole ion trap, dipole excitation can practically occur only in the z-axis direction.

On the other hand, in the quadrupole excitation, the angular frequency Ω of the excitation is expressed by the following equation (2):

$$\Omega=\beta_i\omega,\{n\pm\beta_i\}\omega\ n=1,2,\ldots,\infty \tag{2}$$

In this case, as shown in diagram (b) in FIG. 5, alternating voltages with the same phase are applied to the electrodes facing each other (the pair of end-cap electrodes 22 and 24). This operation allows the captured ion to oscillate in two directions, i.e. along the z and r axes, as shown in diagram (b) in FIG. 5. Such a quadrupole excitation can be achieved by superposing an alternating voltage for excitation on the radio-frequency voltage applied to the ring electrode 21 for the purpose of capturing ions, in addition to applying the excitation voltages of the same polarity to the two end-cap electrodes 22 and 24.

The conventionally known ion selection (mass separation) using an FNF or SWIFT signal also makes use of the previously described resonant excitation discharge. The ion selection using an FNF or SWIFT signal employs an excitation voltage waveform in which voltage waveforms having frequencies calculated by equation (1) or (2) are superposed on each other, exclusive of the resonance frequency corresponding to the mass-to-charge ratio to be selected (retained), i.e. with a notch formed at that frequency. In this case, all the ions to be discharged are excited in the same direction: In the dipole excitation, ions are excited in the direction of the axis of symmetry; in the quadrupole excitation, ions are excited in either the direction of the axis of symmetry or the radial direction.

Figure 9:
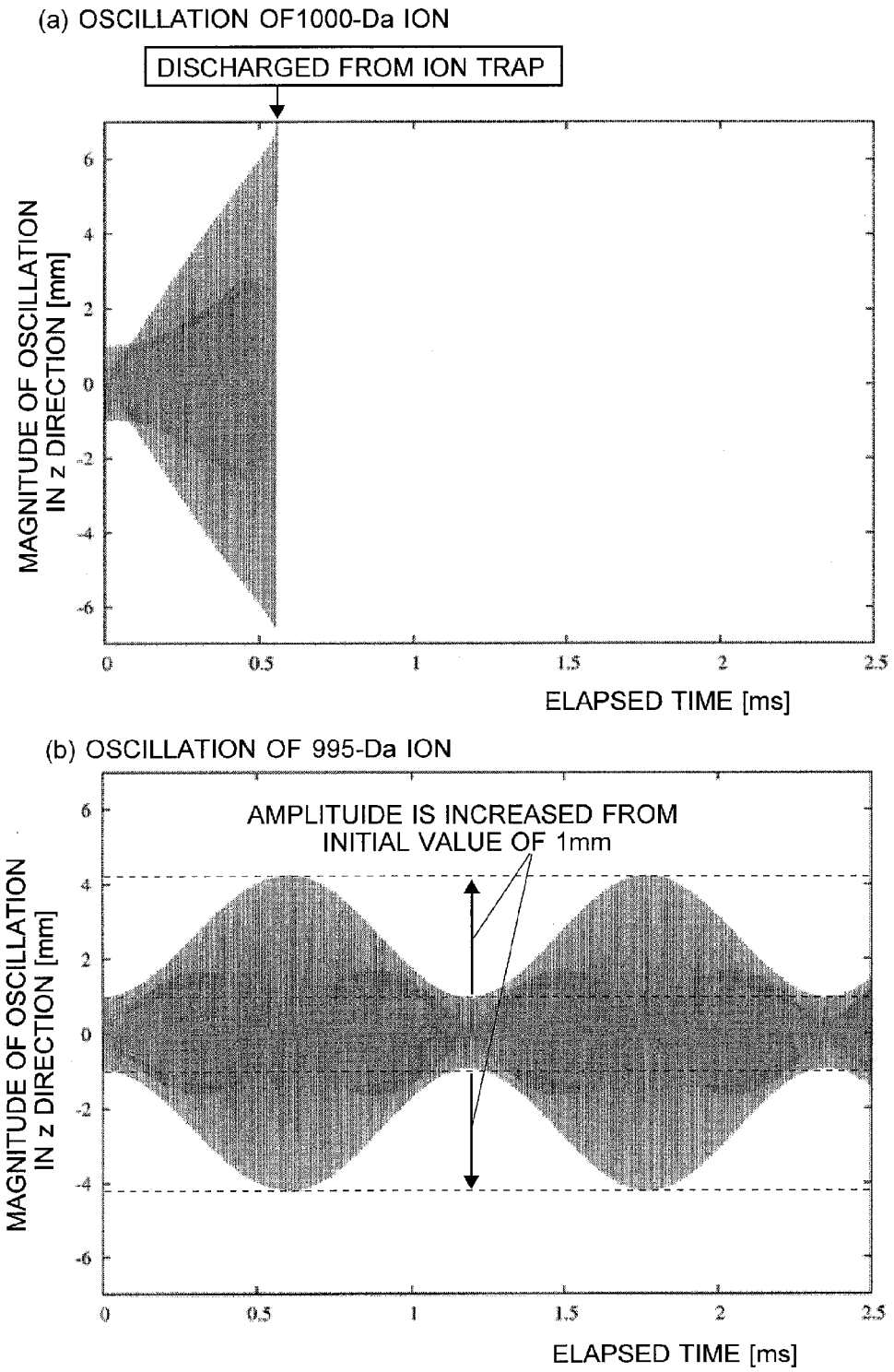
FIG. 9 shows the result of a simulation of the state of oscillation of ions when a dipole excitation for a 1000-Da ion is performed.

In the ion selection method using the previously described conventional resonant excitation discharge, the frequency (or frequency range) which corresponds to the ion (or ion group) to be selected and at which (or within which) no resonant oscillation occurs is sandwiched between the low-mass side frequency range and the high-mass side frequency range of the excitation voltage on the frequency spectrum of the excitation voltage. The ion selectivity for the ion to be selected, or the separating power, is affected by both the end portion of the low-mass side frequency range and that of the high-mass side frequency range. This results in an unfavorable phenomenon that the ion to be retained within the ion trap is also discharged. FIG. 9 shows the result of a simulation of the state of oscillation of ions which was performed on the assumption that a 1000-Da ion and a 995-Da ion, both having a maximum amplitude of 1 mm in the z-axis direction before an excitation voltage was applied, were excited by an excitation voltage with a resonant frequency adjusted for causing a dipole excitation of 1000-Da ion. As shown in diagram (a) in FIG. 9, the 1000-Da ion greatly oscillates due to the resonant excitation and is discharged from the ion trap after the elapse of approximately 0.5 msec. Meanwhile, as shown in diagram (b) in FIG. 9, the 995-Da ion, which is not the target ion, also has its amplitude of oscillation considerably increased due to the application of the excitation voltage.

Figure 10:
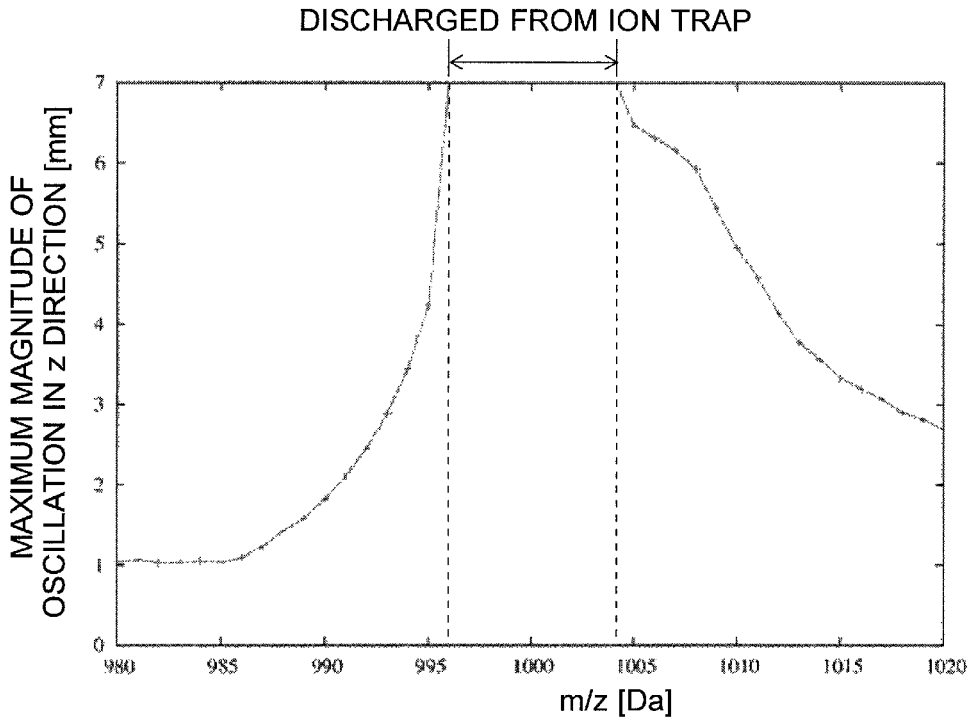
FIG. 10 shows the result of a simulation of the relationship between the mass-to-charge ratio and the maximum magnitude of oscillation when a dipole excitation for a 1000-Da ion is performed.

Thus, an ion whose excitation frequency does not coincide with the frequency of the actually applied excitation voltage will also be excited if its mass-to-charge ratio is close to it. As a result, ions located in the vicinity of the mass-to-charge ratio that should be discharged by resonant excitation will also be simultaneously discharged, as shown in FIG. 10 (in this example, the ions located within a range of approximately ±4 Da are discharged). FIG. 10 shows the result of a simulation of the relationship between the mass-to-charge ratio and the maximum magnitude of oscillation of the ion when a dipole excitation for a 1000-Da ion is performed.

Figure 11:
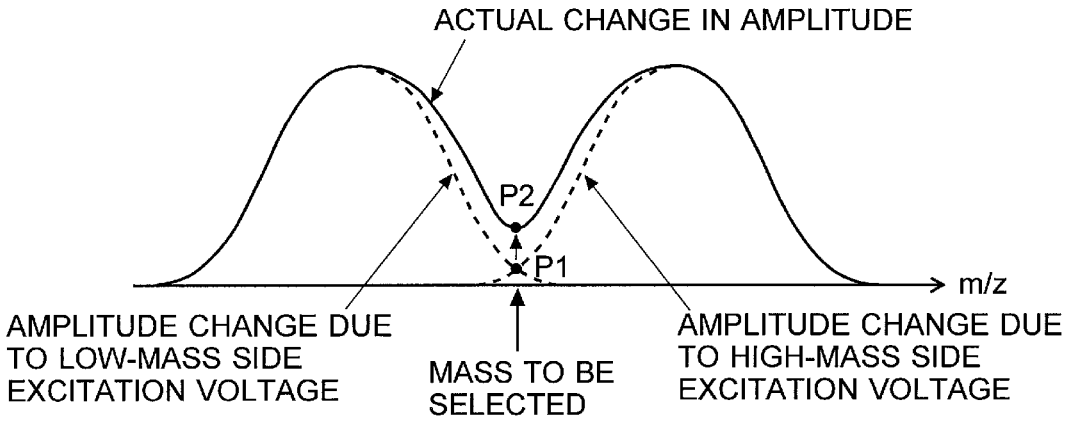
FIG. 11 is a model diagram for explaining a problem arising from a conventional resonant excitation discharge.

FIG. 11 is a model diagram for explaining a problem arising from a conventional resonant excitation discharge, which shows a relationship between the amplitude of ion oscillation caused by resonant excitation and the mass-to-charge ratio. To select a specific ion with high separating power, the ion should have a small amplitude of oscillation (preferably zero). However, due to the previously described phenomenon, the ion to be selected also undergoes an increase in the oscillation amplitude, as schematically shown in FIG. 11 (P1→P2). Other ions whose mass-to-charge ratios are close to that specific ion also have their oscillation amplitudes increased. As a result, the mass-separating power becomes lower. It should be noted that, for ease of explanation, FIG. 11 merely shows the influences of two excitation voltages at the upper end of the low-mass side frequency range and the lower end of the high-mass side frequency range between which the ion to be selected is sandwiched. Actually, the excitation voltages at locations other than those ends also affect the ion to be selected, making the oscillation amplitude of this ion even more increased.

Figure 12:
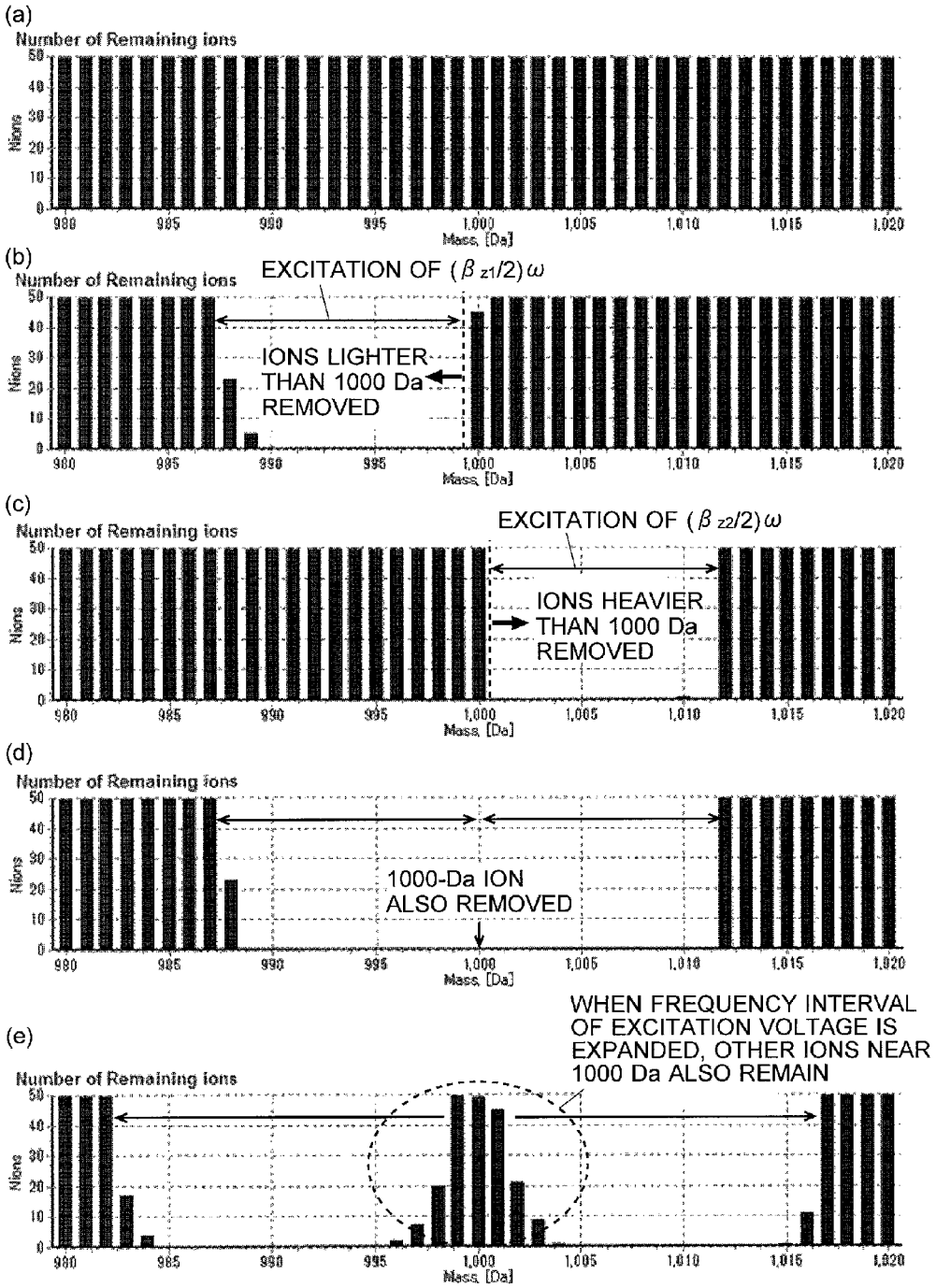
FIG. 12 shows the result of a simulation of the number of ions existing within an ion trap when a resonant excitation discharge by dipole excitation is performed in order to select a 1000-Da ion.

FIG. 12 shows the result of a simulation of the number of ions which exist within the ion trap when the conventional and common technique of resonant excitation discharge by dipole excitation is used to select a 1000-Da ion. Chart (a) in FIG. 12 shows the number of ions initially present within the ion trap. Assumed in this simulation is the situation where 50 ions are present at each of the 1-Da intervals over a range of mass-to-charge ratios from 980 Da to 1020 Da. It is also assumed that, to create an ion-capturing electric field within the ion trap, a rectangular voltage with a wave height of 1 kV is applied to the ring electrode, and that the frequency of this rectangular voltage is adjusted so that a 1000-Da ion shows a motion represented by $\beta_z$=0.5.

Chart (b) in FIG. 12 shows the number of ions remaining within the ion trap after 10 msec from the point where the resonant excitation discharge by dipole excitation was performed by applying, to the end-cap electrodes, a single-frequency excitation voltage corresponding to 992.4 Da, which corresponds to $(\beta_{z1}/2)\omega$. This is the situation where the ions in the low-mass-side vicinity of the 1000-Da ion have been removed.

On the other hand, chart (c) in FIG. 12 shows the number of ions remaining within the ion trap after 10 msec from the point where the resonant excitation discharge by dipole excitation was performed by applying, to the end-cap electrodes, a single-frequency excitation voltage corresponding to 1004.5 Da, which corresponds to $(\beta_z 2/2)\omega$. This is the situation where the ions in the high-mass-side vicinity of the 1000-Da ion have been removed.

As can be seen in charts (b) and (c) in FIG. 12, when each of the two single-frequency excitation voltages is separately applied to the end-cap electrodes, a clear boundary appears between the discharged ions and the remaining ions, whereby a sharp separation is achieved.

By contrast, chart (d) in FIG. 12 shows the number of ions remaining within the ion trap after 10 msec from the point where the resonant excitation discharge by dipole excitation was performed by simultaneously applying, to the end-cap electrodes, the two excitation voltages with different frequencies, i.e. the single-frequency excitation voltage corresponding to 992.4 Da and the single-frequency excitation voltage corresponding to 1004.5 Da. As can be seen in this chart (d) in FIG. 12, when the two excitation voltages with the respective frequencies are applied simultaneously, or in a superposed form, the 1000-Da ion which should be retained is also removed.

In such a resonant excitation discharge by dipole excitation, if the frequency gap between the two simultaneously applied excitation voltages is increased so as to leave the 1000-Da ion within the ion trap, there will be not only the 1000-Da ion but also other ions in its vicinity remaining within the ion trap, as shown in chart (e) in FIG. 12.

The results thus obtained demonstrate that, in the conventional and common technique of resonant excitation discharge by dipole excitation, the target ion can be selected with high separating power when the excitation is separately performed on each of the low-mass and high-mass sides of the ion to be selected, but if an attempt to simultaneously perform the excitation on both the low-mass side and the high-mass side is made in order to increase the selection speed, i.e. if a plurality of excitation voltages with different frequencies are superposed on each other, the separating power becomes lower and it is difficult to select only the target ion. A probable reason is the interaction between the excitation voltage on the low-mass side frequency range and the excitation voltage on the high-mass side frequency range, between which the target ion is sandwiched, and in particular, the interaction between the end portions of these voltages in the vicinity of the target ion. In the case of dipole excitation, the oscillating direction of the ions is inevitably fixed in a single-axis direction, and the ions driven by the two excitation voltages are forced to oscillate in the same direction. However, if the two modes of oscillation occur in different directions, the interaction between the excitation voltage used on the low-mass side and that used on the high-mass side will probably be weakened. Accordingly, in the first ion-selection method of the present invention, the quadrupole excitation, which allows the selection of the oscillating direction of the ions, is used on at least one of the low-mass and high-mass sides and the ions are excited in different directions on the low-mass side and the high-mass side.

Figure 13:
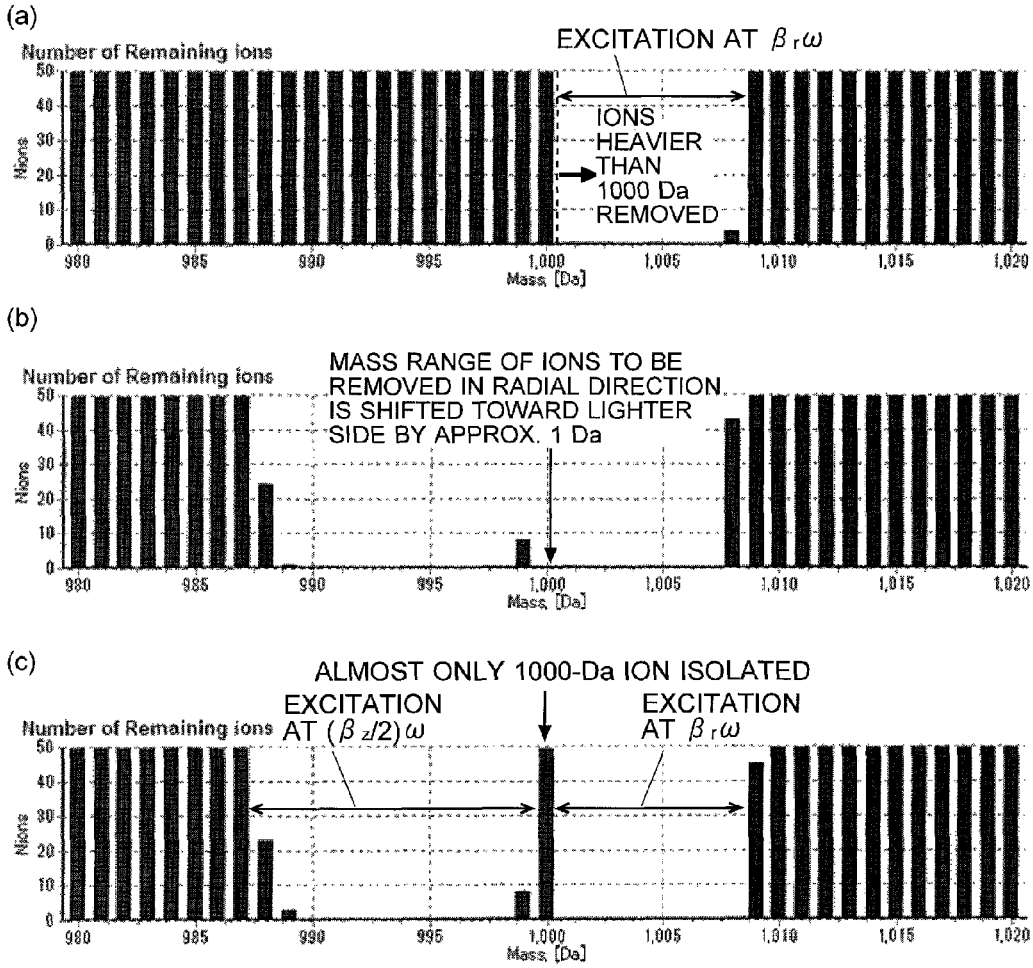
FIG. 13 shows the result of a simulation of the number of ions which exist within an ion trap when a resonant excitation discharge by the first ion-selection method (using dipole excitation on the low-mass side and quadrupole excitation on the high-mass side) is performed.

FIG. 13 shows the result of a simulation in which the excitation on the low-mass side was performed in the direction of the axis of symmetry (z-axis direction) by dipole excitation as in the example of FIG. 12 while the excitation on the high-mass side was performed in the radial direction (r-axis direction) by quadrupole excitation. Chart (a) in FIG. 13 shows the number of ions remaining within the ion trap after 10 msec from the point where the excitation in the radial direction was performed by quadrupole excitation with a single frequency corresponding to 1007.0 Da. Since the amount of excitation energy produced by quadrupole excitation is smaller than that produced by dipole excitation, the amplitude of the excitation voltage for the quadrupole excitation in the radial direction was set at 2 V, which was two times as high as the value used for the dipole excitation. Chart (a) in FIG. 13 evidently demonstrates that ions with mass-to-charge ratios higher than 1000 Da were sufficiently removed.

Chart (b) in FIG. 13 shows the number of ions within the ion trap after 10 msec in the case where the quadrupole excitation in the radial direction for the removal of high-mass side ions shown in chart (a) in FIG. 13 and the dipole excitation in the direction of the axis of symmetry for the removal of low-mass side ions shown in chart (b) in FIG. 12 were simultaneously performed. In this case, the range of mass-to-charge ratios of ions to be removed by the excitation in the radial direction underwent a shift of approximately 1 Da toward the low-mass side, with the result that the target ion of 1000 Da was also removed. To address this problem, the frequency of the excitation voltage was adjusted by way of experiment so that an ion having a mass-to-charge ratio of 1007.8 Da would be the target of the excitation in the radial direction. The result was an almost complete success in isolating only the 1000-Da ion, as shown in chart (c) in FIG. 13. Thus, the results of the simulation described to this point have confirmed that, even if the voltages used for the excitation on the low-mass and high-mass sides of the target ion to be selected are simultaneously applied (i.e. even if two excitation voltages with different frequencies are applied in a superposed form), a high level of separating power can be achieved by exciting the ions in different directions on the low-mass side and the high-mass side.

Figure 14:
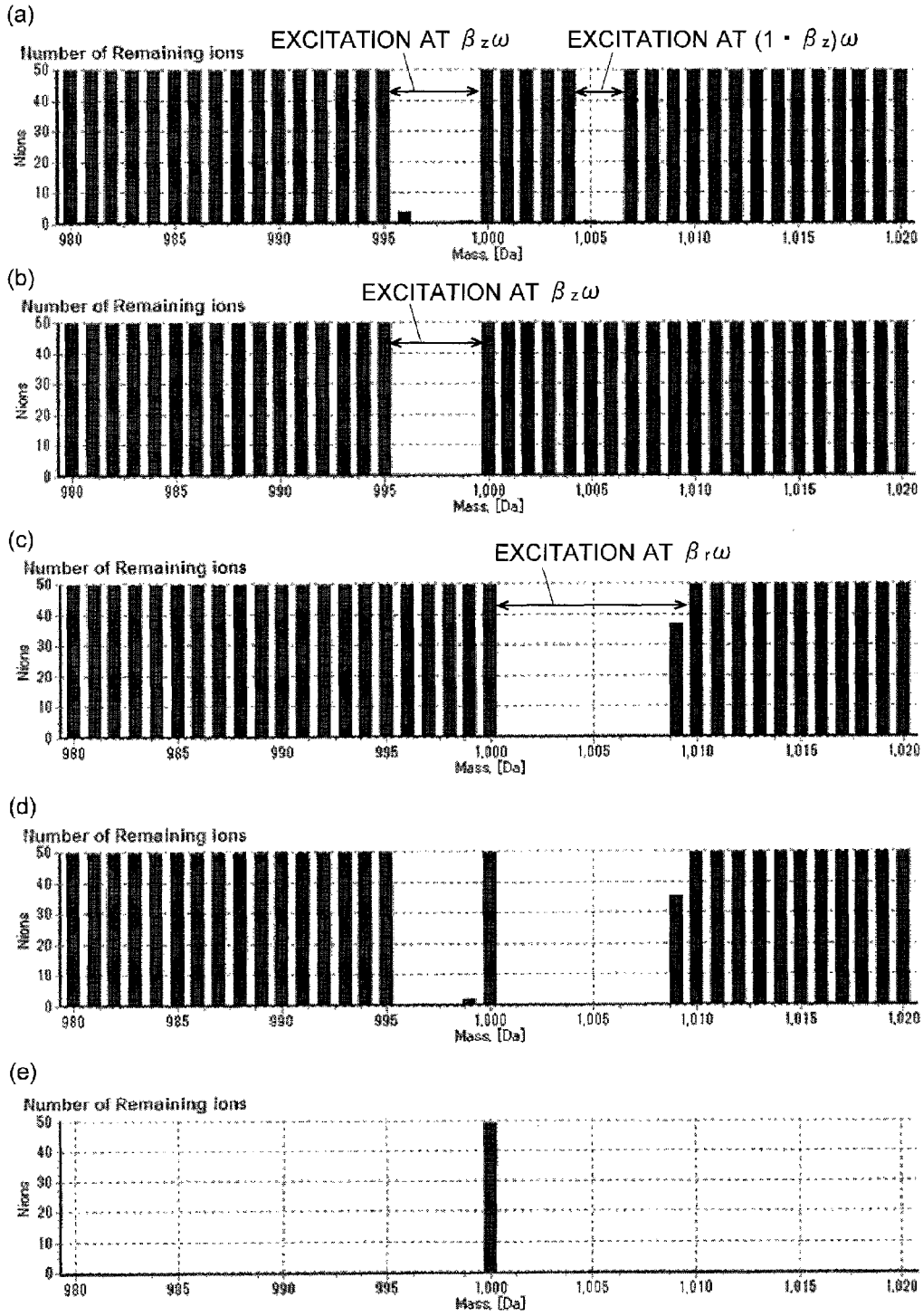
FIG. 14 is shows the result of a simulation of the number of ions which exist within an ion trap when a resonant excitation discharge by the first-ion selection method (using quadrupole excitation on both the low-mass side and the high-mass side) is performed.

In the previously described simulation whose result is shown in chart (c) in FIG. 13, the excitation in the direction of the axis of symmetry on the low-mass side was performed by dipole excitation. FIG. 14 shows the result of a simulation in which the excitation in the direction of the axis of symmetry was also performed by quadrupole excitation in a manner similar to the excitation in the radial direction. When the quadrupole excitation is performed in the direction of the axis of symmetry, if the excitation is performed near $\beta_z$=0.5, there will be not only the excitation of ions which correspond to an excitation voltage whose frequency corresponds to the normal $\beta_z\omega$, but also the excitation of ions corresponding to $(1-\beta_z)\omega$ in their vicinity. As a result, despite the application of a single-frequency excitation voltage, the excitation occurs within two closely located ranges of mass-to-charge ratios, as shown in chart (a) in FIG. 14. Therefore, there is the possibility that, although the excitations on the low-mass side and the high-mass side are intended to occur in different directions, they actually occur in the same direction. To avoid this undesirable effect of the excitation at a frequency of $(1\beta_z)\omega$, the frequency of the ion-capturing radio-frequency voltage applied to the ring electrode was set so that the value of $\beta_z$ of the 1000-Da ion would be 0.45 and not 0.5. Charts (b)-(e) show the simulation result obtained under this condition.

Chart (b) in FIG. 14 shows the number of ions remaining within the ion trap after the elapse of 10 msec in the case where ions were discharged by quadrupole excitation in the direction of the axis of symmetry by applying a single-frequency excitation voltage to the end-cap electrodes. The voltages applied to the end-cap electrodes and the ring electrode were set so as to discharge ions having mass-to-charge ratios lower than 1000 Da. The amplitude of the excitation voltage was set at 2V, the same as used for the excitation in the radial direction. However, as can be seen, the range of mass-to-charge ratios which underwent excitation was further narrowed down as compared to chart (a) in FIG. 13.

Chart (c) in FIG. 14 shows the number of ions remaining within the ion trap after 10 msec from the point of application of an excitation voltage in the case where a single-frequency excitation voltage was applied to the end-cap electrodes to excite ions having mass-to-charge ratios higher than 1000 Da by quadrupole excitation in the radial direction. Chart (d) in FIG. 14 shows the result of a simulation in which the excitation voltages that respectively yielded the results of charts (b) and (c) in FIG. 14 were simultaneously applied to the end-cap electrodes. Unlike chart (b) in FIG. 13, chart (d) in FIG. 14 exactly shows the state obtained by superposing the results of charts (b) and (c) in FIG. 14 on each other. Therefore, when the quadrupole excitation is thus used on both the high-mass side and the low-mass side, it is possible to select the target ion of 1000 Da with high separating power (in the present case, with a separating power of approximately 1 Da), without requiring the frequency adjustment of the excitation voltage as performed in the example in which the excitation on the low-mass side was performed in the direction of the axis of symmetry by dipole excitation (see FIG. 13).

Chart (e) in FIG. 14 shows the result of a simulation in which the range of mass-to-charge ratios of ions to be discharged were expanded by increasing the amplitude of the excitation voltage in the direction of the axis of symmetry to 10 V and that of the excitation voltage in the radial direction to 5 V. As can be seen, increasing the amplitudes of the excitation voltages expands the range of mass-to-charge ratios of the ions to be discharged. This is advantageous for a rough isolation which may be performed as will be described later before the ion isolation with high-separating power, since the expanded mass-to-charge ratio range allows a wider range of mass-to-charge ratios of the ions to remain within the ion trap after the rough isolation, thus making the rough isolation easier to perform and quicker to be completed. Chart (e) in FIG. 14 also shows that, even if the amplitudes of the excitation voltages are increased, the quadrupole excitation maintains a high level of separating power and can sufficiently isolate the target ion of 1000 Da.

Thus, it has been confirmed that, with the three-dimensional quadrupole ion trap 2 as shown in FIG. 2, it is possible to select a target ion with high separating power while reducing the amount of time required for discharging ions, by performing a single-frequency resonant excitation discharge operation for exciting ions in a different direction on each of the low-mass and high-mass sides of the ion to be selected. As already explained, in the simulation shown in charts (b)-(e) in FIG. 14, the frequency of the voltage applied to the ring electrode was adjusted so that the $\beta_z$ value of the 1000-Da ion would become 0.45 so as to avoid the influence of the excitation at the undesirable frequency of $(1-\beta_z)\omega$. The $\beta_z$ value may be set at any appropriate value for avoiding 0.5. For example, $\beta_z$ may be greater than 0.5, e.g. 0.55.

In the case of a linear ion trap, the ion capturing is performed in two directions (x and y axes) perpendicular to the central axis (z axis) of the four rod electrodes, and the same technique as applied in the three-dimensional quadrupole ion trap can be used to improve its separating power of the ion selection. In the case of performing dipole excitation in a linear ion trap, it is possible to cause excitations in different directions by superposing an excitation voltage waveform on the voltage applied to the electrodes located in each direction in which the excitation needs to be caused. For example, when the excitation on the low-mass side is to be caused in the x-axis direction and the excitation on the high-mass side is to be caused in the y-axis direction, the intended result can be obtained by applying an excitation voltage for removing low masses side ions to the electrodes located in the x-axis direction and an excitation voltage for removing high masses side ions to the electrodes located in the y-axis direction.

In the case of performing quadrupole excitation in a linear ion trap, if the dimensionless parameter a of the ion trap is 0, the excitations in the two directions simultaneously occur and it is impossible to cause the excitations in different directions. However, the β values in the respective directions, $(\beta_x, \beta_y)$, can be made to be different from each other by applying a direct voltage to the electrodes facing each other across the central axis, or by making the value of a different from zero by changing the duty ratio of the ion-capturing radio-frequency voltage if this voltage has a rectangular waveform. Thus, the direction of excitation can be limited to a specific direction.

[Second Ion-Selection Method]

Another technique of the ion selection method according to the present invention will be hereinafter described with reference to the drawings. In the present example, the method of ion selection and its effects will be described based on experimental results obtained with an actual apparatus and not obtained by simulation.

Figure 15:
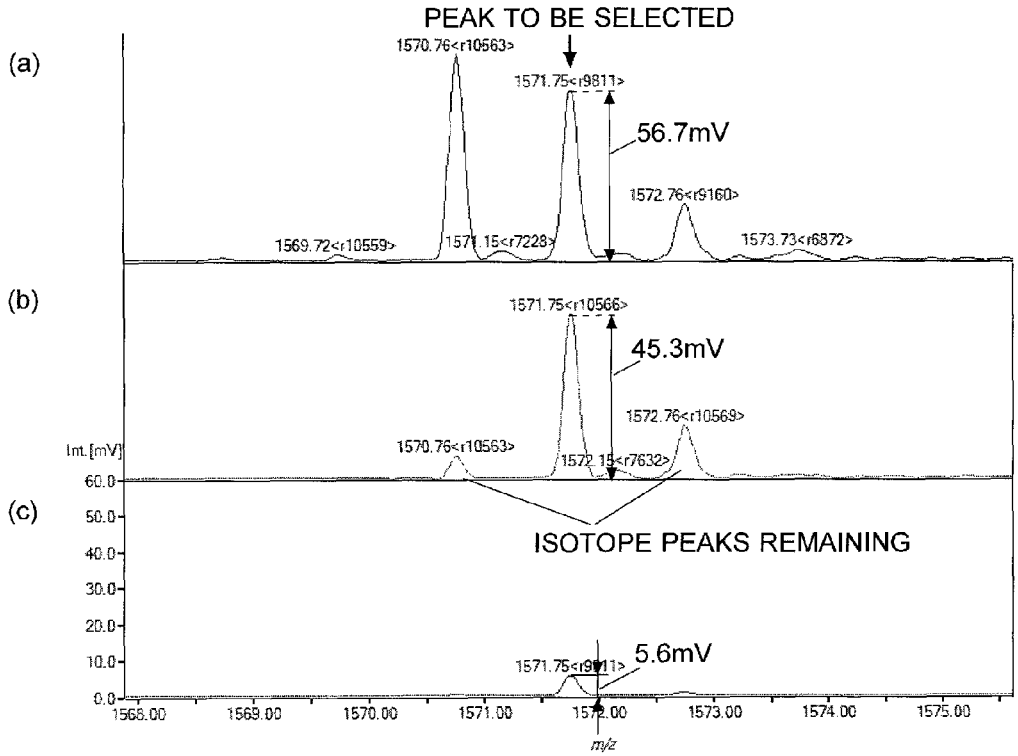
FIG. 15 shows the result of an experiment performed by an ion selection method using a conventional FNF signal.

FIGS. 15-18 each show mass spectra obtained with an actual apparatus. FIG. 15 shows mass spectra obtained by a conventional ion selection using an FNF signal. Specifically, diagram (a) shows a mass spectrum obtained with a group of roughly isolated peaks including the first isotope peak of Glu-fib. Diagrams (b) and (c) in FIG. 15 show mass spectra obtained after the ions roughly isolated within the ion trap in the previously described way were more finely isolated by an ion selection using an FNF signal. Diagram (b) shows the result obtained in the case where the isolation was performed with the conditions set so that the peak to be selected would have a high signal intensity even after the isolation. Even after the isolation, the signal intensity of the peak was as high as approximately 80% of the level observed before isolation, which can be said to be an adequately high signal intensity. However, in this case, unnecessary isotope peaks were left on both sides of the target peak.

On the other hand, diagram (c) in FIG. 15 shows the result obtained in the case where the ion selection using an FNF signal was performed with the conditions set so that no unnecessary isotope peaks would be left. In this case, unnecessary peaks other than the first isotope peak of Glu-fib as the target were adequately removed. However, the signal intensity of the first isotope peak itself was also considerably decreased and became approximately 10% of the level observed before isolation. Thus, in the ion selection using an FNF signal, reducing the amount of decrease in the intensity of the target peak leads to a poor isolation, while attaching greater importance to the isolation noticeably decreases the intensity of the target peak.

Figure 16:
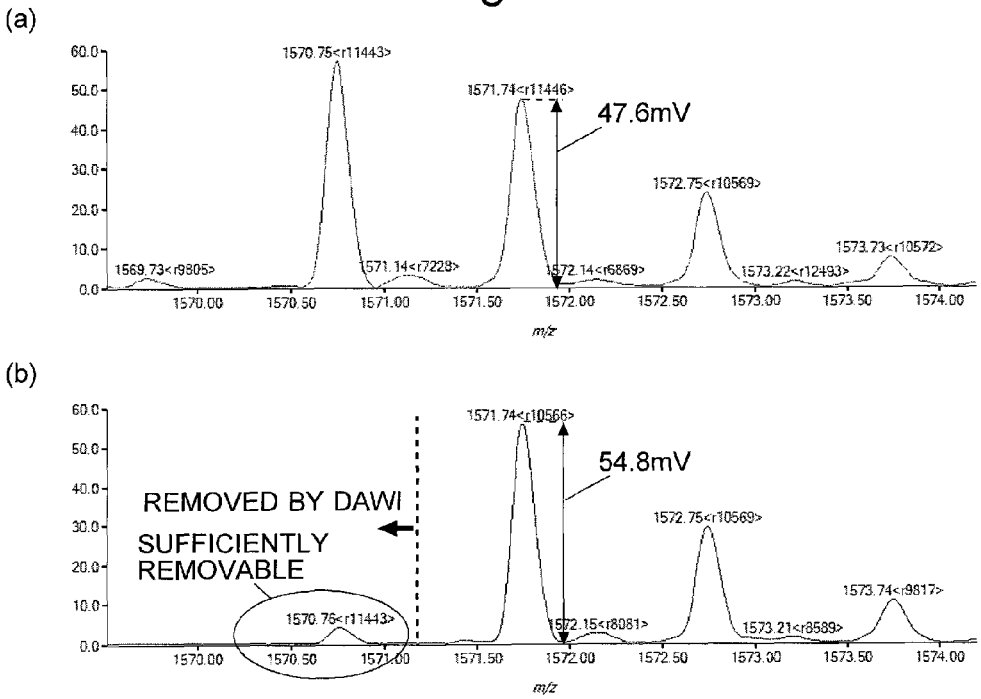
FIG. 16 shows the result of an experiment in which an isolation by DAWI was performed after a rough isolation using an FNF signal was performed.

By contrast, chart (b) in FIG. 16 shows a mass spectrum obtained by performing the same ion-discharging operation as in the case of FIG. 15 until the rough isolation and subsequently performing DAWI. Although the unnecessary peaks on the high-mass side of the first isotope peak of Glu-fib remained almost intact, the unnecessary peaks on the low-mass side were adequately removed. The signal intensity of the target peak, or the first isotope peak, was approximately as high as the signal intensity observed after the rough isolation shown in diagram (a) in FIG. 16. Although the signal intensity in diagram (b) in FIG. 16 is higher than that shown in diagram (a) in FIG. 16, this increase is within the range of variation in the amount of ions generated for each shot of laser beam in MALDI. Thus, when DAWI is used, although the separating power is insufficient on the high-mass side, the mass selection can be performed with high separating power on the low-mass side.

Figure 6:
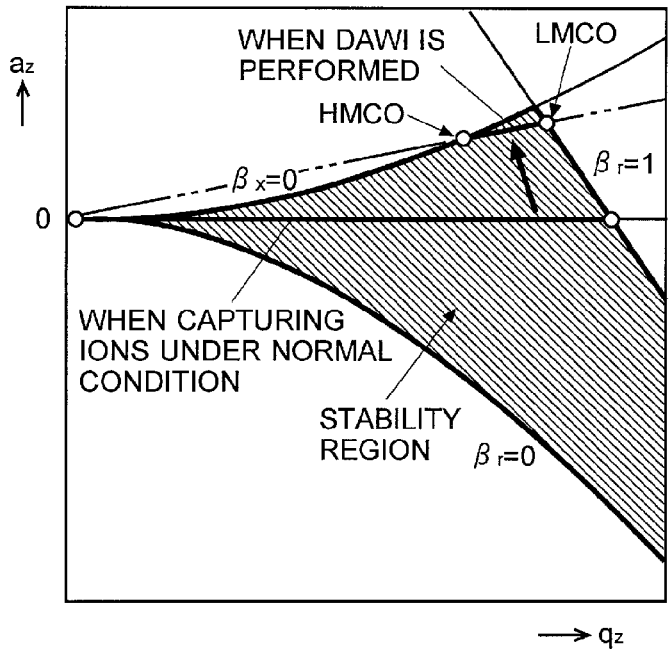
FIG. 6 is a Mathieu's stability diagram for explaining an ion-discharging operation by DAWI.

The reason for such a large difference in the separating power between the low-mass side and the high-mass side can be understood as follows: FIG. 6 is a stability diagram in a three-dimensional quadrupole ion trap based on a Mathieu equation. In this diagram, the region surrounded by $\beta_x=0$, $\beta_r=0$ and $\beta_r=1$ is the stability region where ions can exist in a stable form within the capturing region. Under the normal ion-capturing condition, the horizontal line $a_z=0$ in FIG. 6 is the working line, which allows ions within a wide range of mass-to-charge ratios to be included in the stability region. When ions are to be discharged by DAWI or a similar ion-selection method, the working line is made to be positively sloped, as indicated by the arrow. The points at which this working line intersects with the boundary lines of the stability region, or specifically, the points at which this line intersects with $\beta_x=0$ and $\beta_r=1$ respectively correspond to the upper limit mass (HMCO) and the lower limit mass (LMCO) that can be captured. As can be seen, the segment of the working line between the upper and lower limit masses is short, which means that the range of mass-to-charge ratios that can be captured in a stable form is narrow.

The ions captured within the ion trap are oscillating in a pseudo-potential well created within the ion trap by the radio-frequency electric field. The depth of this pseudo-potential well is proportional to $q_z$, and therefore, the pseudo-potential well is deep on the lower limit mass side. Furthermore, in the vicinity of the lower limit mass along $\beta_r=1$, the change in $q_z$ is small, and therefore, the change in the depth of the pseudo-potential well is also small. Thus, whether or not an ion will be captured depends primarily on its amplitude of oscillation, and there is only a small variation in the lower limit mass. As a result, a high level of separating power is achieved on the low mass side. By contrast, on the upper limit mass side, the pseudo-potential well is shallow. Furthermore, in the vicinity of the upper limit mass along $\beta_x=0$, the change in $q_z$ is considerably large, and therefore, the change in the depth of the pseudo-potential well is also large. That is to say, ions having almost equal amplitudes of oscillation may or may not be captured if the depth of the pseudo-potential well changes. As a result, the upper limit mass considerably varies, which lowers the separating power on the high mass side.

Figure 17:
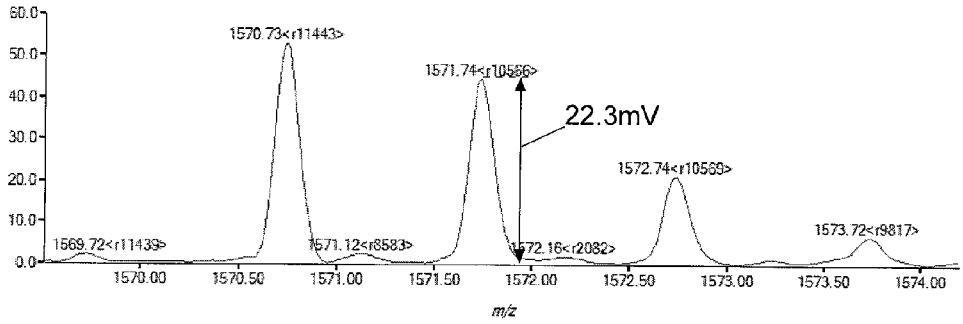
FIG. 17 shows the result of an experiment in which an isolation by quadrupole excitation was additionally performed after the isolation shown in FIG. 16 was performed.
Figure 17:
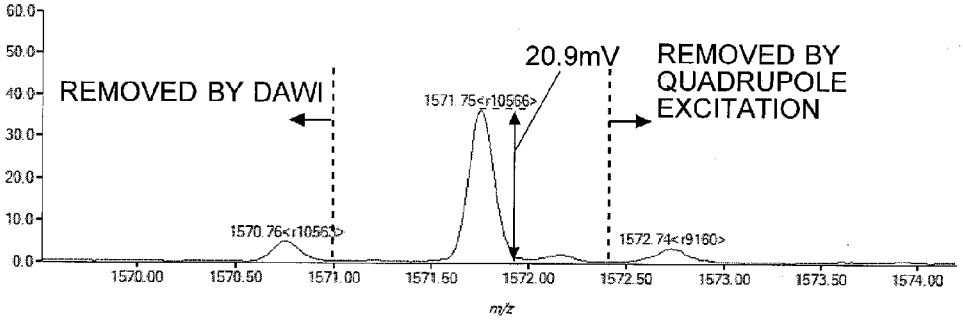

As shown in diagram (b) in FIG. 16, unnecessary ions on the low-mass side can be sufficiently removed as a result of DAWI. However, unnecessary ions on the high-mass side remains. These ions cannot be removed by DAWI. To address this problem, in the second ion-selection method, resonant excitation discharge has been adopted for the removal of unnecessary ions on the high-mass side, as in the case of the previously described first ion-selection method. Diagram (a) in FIG. 17 is a mass spectrum obtained without performing an ion selection for Glu-fib, while diagram (b) is a mass spectrum obtained by initially removing the peaks on the low-mass side of the first isotope peak of Glu-fib by DAWI and then removing the peaks on the high-mass side by quadrupole excitation with a single excitation frequency. In this measurement, after the DAWI was completed, a short cooling time of several milliseconds was provided before the quadrupole excitation was performed, although such a cooling process is not necessary under optimum conditions.

As is clear from the comparison of diagram (b) in FIG. 17 with diagram (b) in FIG. 16, the peaks other than the first isotope peak of Glu-fib were almost completely removed. The signal intensity of the first isotope peak of Glu-fib was approximately 90% of the level observed before isolation (diagram (a) in FIG. 17), which demonstrates that the amount of ions observed before isolation was almost entirely maintained.

As described to this point, by the second ion-selection method including the steps of initially removing unnecessary ions on the low-mass side by DAWI and subsequently removing unnecessary ions on the high-mass side by quadrupole excitation, it is possible to select only the target ion with high separating power while reducing the amount of decrease in the signal intensity of the target ion, as in the case of the first ion-selection method.

Figure 18:
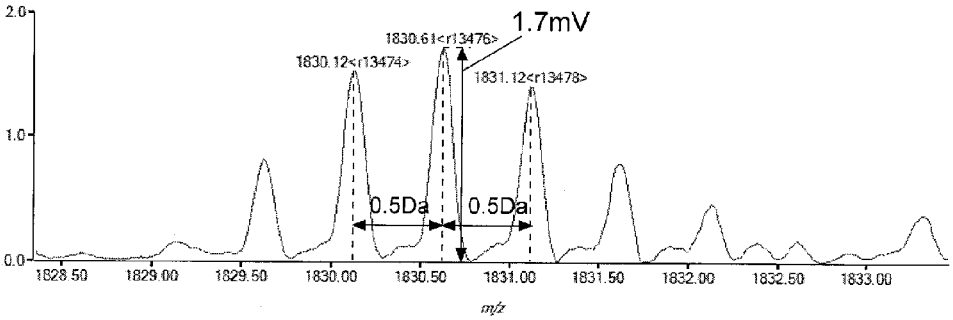
FIG. 18 shows the result of another experiment in which an isolation by quadrupole excitation was additionally performed after the isolation shown in FIG. 16 was performed.
Figure 18:
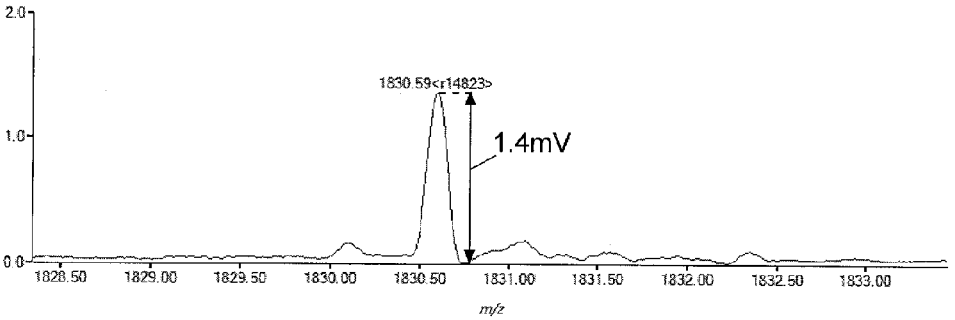

Furthermore, the second ion-selection method allows a mass selection with an even narrower range, and FIG. 18 shows the result. Diagram (a) in FIG. 18 is a mass spectrum of a dimer of ACTH(7-38) obtained without performing an ion selection, and diagram (b) is a mass spectrum obtained by performing an ion selection for the second isotope peak of the same substance using the second ion-selection method. Since the substance was a dimer, the intervals of the isotope peaks were reduced to 0.5 Da. As is clear from diagram (b) in FIG. 18, the unnecessary peaks located at intervals of 0.5 Da were sufficiently removed, while the signal intensity of the target peak remained as high as approximately 80% of the level observed before isolation. Thus, by the second ion-selection method, it is possible to correctly select only the target peak even if unnecessary peaks exist in close proximity to the target peak.

[System for Carrying Out First and Second Ion-Selection Methods]

One embodiment of the mass spectrometer having an ion trap system for carrying out the first and second ion-selection methods as previously described is hereinafter described with reference to the attached drawings.

Figure 1:
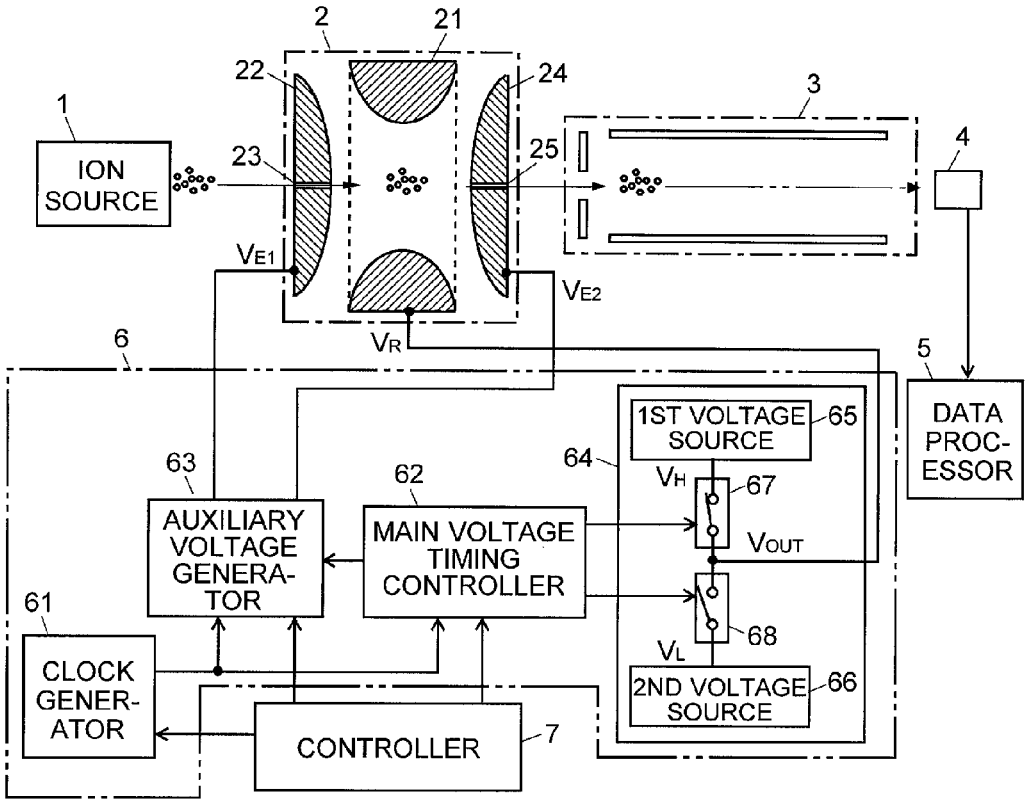
FIG. 1 is a configuration diagram of the main components of a DIT-TOFMS as one embodiment of the present invention.

FIG. 1 is a configuration diagram showing the main components of an ion-trap time-of-flight mass spectrometer (IT-TOFMS) of the present embodiment.

The IT-TOFMS according to the present embodiment includes an ion source 1 for ionizing a target sample, a three-dimensional quadrupole ion trap 2 having the configuration shown in FIG. 2, a time-of-flight mass separator 3, an ion detector 4, a data processor 5 for processing data obtained with the ion detector 4 to create mass spectra or other forms of information, an ion trap driver 6 for driving the ion trap 2, and a controller 7 for controlling each component of the system.

The ionization method in the ion source 1 is not particularly limited. For example, when the sample is in liquid form, an atmospheric ionization method is used, such as the electrospray ionization (ESI) or atmospheric pressure chemical ionization (APCI). When the sample is in solid form, the matrix assisted laser desorption/ionization or a similar method is used.

For example, the detector 4 may be composed of a conversion dynode for converting incident ions into electrons and a secondary electron multiplier tube for multiplying and detecting electrons produced by the conversion. Instead of providing the time-of-flight mass separator 3, a configuration may be adopted in which ions are sequentially discharged by the mass-separating function of the ion trap 2 itself and directly introduced into and detected by the ion detector 4.

The ion trap driver 6 includes a clock generator 61, a main voltage timing controller 62, an auxiliary voltage generator 63, a main voltage generator 64 and other components. The main voltage generator 64, which is used for applying an ion-capturing rectangular voltage to the ring electrode 21, includes a first voltage source 65 for generating a first voltage $V_H$ and a second voltage source 66 for generating a second voltage $V_L$ ($V_L<V_H$), as well as first and second switches 67 and 68 serially connected between the output terminal of the first voltage source 65 and that of the second voltage source 66. The switches 67 and 68 are power switching elements that can operate at high speeds, such as power MOSFETs.

Figure 7:
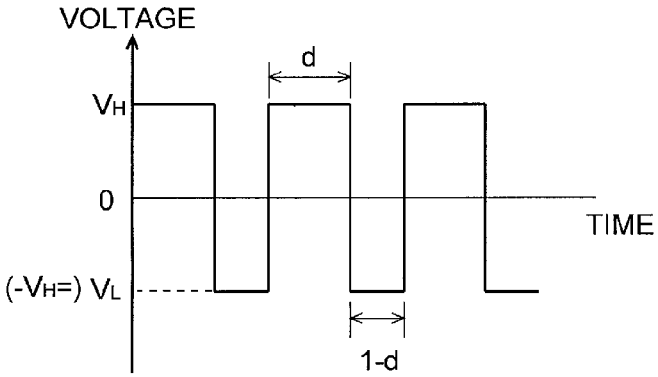
FIG. 7 shows the waveform of a rectangular voltage applied to an electrode in a DIT.

The main voltage timing controller 62 includes an RF voltage waveform memory (which is not shown). It reads RF voltage waveform data stored in the RF voltage waveform memory, generates, for example, two complementary trains of drive pulses based on the read data, and supplies those pulses to the switches 67 and 68. The first voltage $V_H$ is outputted when the first switch 67 is ON and the second switch 68 is OFF, while the second voltage $V_L$ is outputted when the second switch 68 is ON and the first switch 67 is OFF. Therefore, ideally, the output voltage $V_{OUT}$ from the main voltage generator 64 will be in the form of a rectangular voltage alternating between the high level $V_H$ and the low level $V_L$ at predetermined frequency f, as shown in FIG. 7. Normally, $V_H$ and $V_L$ are high voltages having the same absolute value and opposite polarities, the absolute value being approximately a few hundred V to 1 kV. The frequency f is normally within a range from several tens of kHz to several MHz. The rectangular voltage applied to the ring electrode 21 usually has a simple repetitive waveform alternating at a predetermined frequency. The use of the RF voltage waveform data stored in the RF voltage waveform memory makes it easy to arbitrarily set the duty ratio (d in FIG. 7) or slightly adjust the timing so as to prevent the two trains of drive pulses from being simultaneously ON.

On the other hand, the auxiliary voltage generator 63 applies a direct voltage or a rectangular low voltage to each of the pair of end-cap electrodes 22 and 24. In general, a direct voltage is applied to the end-cap electrodes 22 and 24 when ions are introduced into the ion trap 2 or the captured ions are ejected from the ion trap 2 toward the time-of-flight mass separator 3, while a rectangular low voltage is applied to the end-cap electrodes 22 and 24 when the resonant excitation discharge is performed to select ions or for other purposes. As described in Non Patent Literature 1, when the resonant excitation discharge is performed in a DIT, a rectangular low voltage having a frequency obtained by a ¼-division of the rectangular voltage applied to the ring electrode 21 is normally applied to the end-cap electrodes 22 and 24. Accordingly, the main voltage timing controller 62 gives the auxiliary voltage generator 63 a pulse signal produced by dividing the drive pulse supplied to the main voltage generator 64 at a ratio of ¼ (or any other appropriate ratio). Based on this pulse signal, the auxiliary voltage generator 63 can produce a rectangular low voltage which has a frequency of f/4 and a predetermined voltage value. Normally, the voltage level of the rectangular low voltage is dramatically lower than the voltage level $V_H$ and $V_L$ of the rectangular high voltage applied to the ring electrode 21; for example, it is within a range from a few V to 10 V.

In the case where the rough isolation in the ion selection is performed using an FNF signal or similar broad-band signal, the broad-band signal can be generated, as described in JP 2012-49056 A for example, by previously storing digital data of the broad-band signal in a memory of the auxiliary voltage generator 63, and later on, by D/A-converting the data sequentially read from the memory into analogue signals based on a clock signal synchronized with the reference clock signal used in the main voltage timing controller 62. Naturally, it is possible to adopt various conventionally known techniques available for generating voltages for carrying out resonant excitation discharge, regardless of whether it is the dipole excitation or quadrupole excitation.

Figure 3:
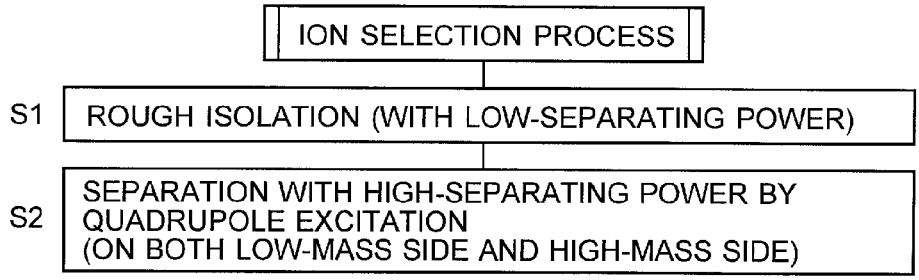
FIG. 3 is a schematic flowchart of the first ion-selection method according to the present invention.

One example of the operation of performing a precursor isolation by the first ion-selection method in the IT-TOFMS of the present embodiment is hereinafter described with reference to the flowchart of FIG. 3.

Various kinds of ions generated from a sample in the ion source 1 are introduced through the ion injection hole 23 into the ion trap 2. During this process, a rectangular high voltage with a predetermined frequency is applied from the main voltage generator 64 to the ring electrode 21, while the end-cap electrodes 22 and 24 are maintained at a constant potential. As a result, an ion-capturing electric field is created within the ion trap 2, whereby the various kinds of ions are captured. Although not shown, cooling gas is normally introduced into the ion trap 2. The ions introduced into the ion trap 2 come in contact with this cooling gas and become cooled.

Subsequently, an ion selection process is performed so as to selectively leave only a previously indicated precursor ion within the ion trap 2. Initially, as the first stage, a rough isolation is performed to remove ions having mass-to-charge ratios higher and lower than a predetermined range of mass-to-charge ratios inclusive of the mass-to-charge ratio of the precursor ion, thus leaving the ions included in that predetermined range (Step S1). The rough isolation may have a low level of separating power but should preferably be capable of quickly removing ions. For example, a technique using an FNF signal or a technique based on DAWI can be used. The range of mass-to-charge ratios to be retained in the rough isolation should preferably be narrow, while best efforts must also be made to avoid a decrease in the quantity of the target precursor ion due to the rough isolation. For example, judging from the simulated result shown in FIG. 12, a satisfactory result can be obtained by setting the notch width in the FNF signal and other relevant conditions so as to leave ions within a range of ±3 to 5 Da from the precursor ion.

The second stage subsequent to the rough isolation is aimed at removing unnecessary ions remaining on the low-mass side of the precursor ion as well as those remaining on the high-mass side. To this end, the auxiliary voltage generator 63 under the control of the controller 7 generates a voltage composed of two excitation voltages superposed on each other, each voltage having a predetermined single frequency corresponding to one of the two groups of unnecessary ions, and applies the voltage of the same polarity to the end-cap electrodes 22 and 24. Meanwhile, an appropriate rectangular voltage is applied to the ring electrode 21 (Step S2). As described earlier, for example, quadrupole excitation is performed on both the low-mass side and the high-mass side, where the voltage condition is set so that one excitation occurs in the direction of the axis of symmetry (z-axis) and the other excitation occurs in the radial direction (r-axis). This setting allows almost no mutual interference between the two excitations which are simultaneously performed at different frequencies. Thus, it is possible to greatly oscillate unnecessary ions and remove them from the ion trap 2 while preventing the precursor ion from oscillation.

After the target precursor ion is thus singly left within the ion trap 2 by the two-stage ion selection, collision-induced dissociation gas is introduced into the ion trap 2, and voltages are applied to the end-cap electrodes 22 and 24 so as to excite the precursor ion. The excited precursor ion comes in contact with the collision-induced dissociation gas and becomes fragmented. This fragmenting operation is continued for a predetermined period of time. After being cooled, the product ions generated by the fragmentation are ejected from the ion trap 2 through the ion ejection hole 25 and introduced into the time-of-flight mass separator 3, to be subjected to mass spectrometry. Based on the detection signals sequentially obtained from the ion detector 4, the data processor 5 creates a mass spectrum of the product ions.

In the IT-TOFMS of the present embodiment, unnecessary ions other than the precursor ion are almost completely removed with high separating power by the ion selection, while the precursor ion is prevented from undergoing a significant decrease in quantity. Therefore, the eventually obtained mass spectrum is highly accurate and sensitive, with few undesirable noise peaks. Although the ion selection for isolating the precursor ion is performed in two stages, the ion selection process can be quickly completed, since it includes no time-consuming operation, such as the frequency scan. Thus, the throughput of the analysis is improved.

Figure 4:
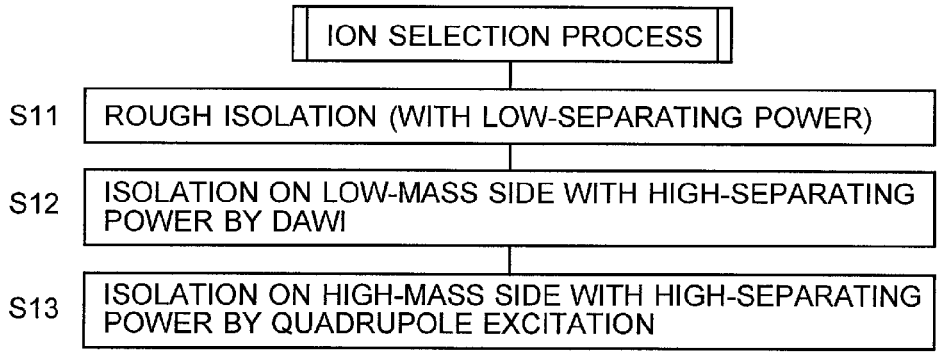
FIG. 4 is a schematic flowchart of the second ion-selection method according to the present invention.

Next, one example of the operation of performing a precursor isolation by the second ion-selection method in the IT-TOFMS of the present embodiment is described with reference to the flowchart of FIG. 4.

As described previously, after various kinds of ions produced from a sample are captured within the ion trap 2, an ion selection process is performed so as to selectively leave only the precursor ion within the ion trap 2. As the first stage, a rough isolation is performed in the same manner as in the first ion-selection method (Step S11). There is no particular difference in the method of this rough isolation.

Figure 8:
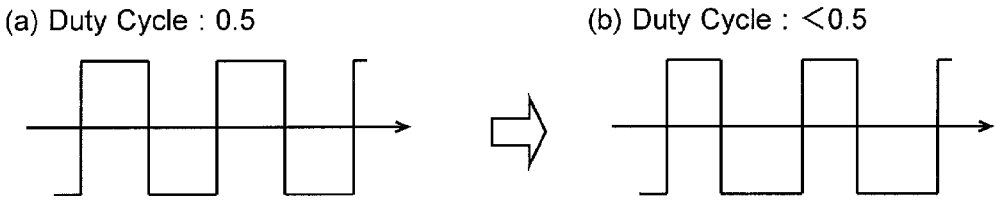
FIG. 8 shows the waveform of a rectangular voltage used in an ion-discharging operation by DAWI.

The second stage subsequent to the rough isolation is aimed at removing unnecessary ions remaining on the low-mass side of the precursor ion. To this end, the main voltage timing controller 62 under the control of the controller 7 generates a pulse signal which makes the duty ratio of the rectangular high voltage applied to the ring electrode 21 equal to a predetermined value corresponding to the mass-to-charge ratio of the precursor ion, and sends this signal to the main voltage generator 64. As a result, the duty ratio of the rectangular high voltage applied from the main voltage generator 64 to the ring electrode 21 changes, for example, as shown in FIG. 8. Normally, when the rectangular high voltage has a duty ratio of 0.5 (see diagram (a) in FIG. 8), the working line on the stability diagram realized by the capturing electric field created within the ion trap 2 by this voltage is represented by the horizontal line $a_z=0$ in FIG. 6. When the duty ratio is changed in the aforementioned way, the working line on the stability diagram becomes sloped, causing a shift in the lower limit mass that can be captured. Accordingly, if the duty ratio is previously determined so that the lower limit mass will be slightly lower than the target precursor ion, the unnecessary ions remaining on the side lower than the precursor ion as a result of the rough isolation will be removed (Step S12).

Subsequently, to remove unnecessary ions remaining on the high mass side of the precursor ion, the auxiliary voltage generator 63 under the control of the controller 7 applies, to the end-cap electrodes 22 and 24, an excitation voltage with a predetermined frequency corresponding to the mass-to-charge ratio of the precursor ion. As a result, the unnecessary ions having mass-to-charge ratios higher than the precursor ion are greatly oscillated by resonant excitation and eventually removed from the ion trap 2.

After the target precursor ion is thus singly left within the ion trap 2, it is possible to perform a mass spectrometry on the product ions obtained by fragmenting the precursor ion and acquire a mass spectrum in the previously described way.

In the second ion-selection method, the rough isolation in Step S11 and the removal of the low-mass side ions with high resolving power by DAWI in Step S12 may be performed in a practically simultaneous fashion. That is to say, the DAWI-based ion selection can be performed from the beginning to remove unnecessary ions on the low-mass side of the precursor ion including the closely located ions, while the removal of the ions on the high-mass side are performed with the upper limit mass being set at an appropriately high value so that the precursor ion will not be removed.

In the DIT, an ion selection equivalent to the DAWI, i.e. the removal of ions by changing the lower and upper limit masses by shifting the position of the working lien on the stability diagram, can be achieved by giving a direct-current offset to the rectangular high voltage instead of changing its duty ratio. The addition of the offset makes $V_L \neq V_H$ in FIG. 7 and changes the area ratio of the positive-polarity side and the negative-polarity side across the line of 0 V, thus producing practically the same effect as obtained by changing the duty ratio.

Although the previous descriptions have exclusively dealt with the DIT, the present invention can also be applied in the AIT. It should be naturally appreciated that resonant excitation discharge can also be used in the AIT as well as in the DIT. Furthermore, it is evident that an ion discharge equivalent to the DAWI in the DIT can also be performed in the AIT by temporarily applying a direct voltage to the end-cap electrodes or ring electrode as described in Patent Literature 2.

Additionally, although the previous descriptions have exclusively dealt with the three-dimensional quadrupole ion trap, it is possible to apply the present invention in a linear ion trap capable of capturing ions and performing resonant excitation discharge based on the same principles, and thereby produce the previously described effects.

REFERENCE SIGNS LIST

1 . . . Ion Source
2 . . . Ion Trap
21 . . . Ring Electrode
22, 24 . . . End-Cap Electrode
23 . . . Ion Injection Hole
25 . . . Ion Ejection Hole
3 . . . Time-of-Flight Mass Separator
4 . . . Ion Detector
5 . . . Data Processor
6 . . . Ion Trap Driver
61 . . . Clock Generator
62 . . . Main Voltage Timing Controller
63 . . . Auxiliary Voltage Generator
64 . . . Main Voltage Generator
65 . . . First Voltage Source
66 . . . Second Voltage Source
67 . . . First Switch
68 . . . . Second Switch
7 . . . Controller

The invention claimed is:

1. An ion selection method for selecting an ion having a specific mass-to-charge ratio or an ion group having a specific range of mass-to-charge ratios from among ions captured in an ion trap composed of three or more electrodes, the method comprising:

a) a low-mass side ion isolation step, in which unnecessary ions having mass-to-charge ratios lower than the specific mass-to-charge ratio or the specific range of mass-to-charge ratios to be selected are removed by performing, on the ions captured in the ion trap, an ion-discharging operation in which a portion of the ions are discharged by shifting a position of a working line on a stability diagram based on a Mathieu equation and thereby changing a lower limit mass that can be captured; and b) a high-mass side ion isolation step, in which unnecessary ions having mass-to-charge ratios higher than the specific mass-to-charge ratio or the specific range of mass-to-charge ratios to be selected are removed by performing, on the ions captured in the ion trap, an ion-discharging operation in which a portion of the ions are discharged by using a resonant excitation, where the two steps are performed in this order, in a reverse order or simultaneously.

2. An ion selection method for selecting an ion having a specific mass-to-charge ratio or an ion group having a specific range of mass-to-charge ratios from among ions captured in an ion trap composed of three or more electrodes, the method comprising:

a) a low-mass side ion isolation step, in which unnecessary ions having mass-to-charge ratios lower than the specific mass-to-charge ratio or the specific range of mass-to-charge ratios to be selected are removed by performing, on the ions captured in the ion trap, an ion-discharging operation in which a portion of the ions are discharged by using a resonant excitation using an excitation voltage having a predetermined single frequency for oscillating the ions in a first direction; and b) a high-mass side ion isolation step, in which unnecessary ions having mass-to-charge ratios higher than the specific mass-to-charge ratio or the specific range of mass-to-charge ratios to be selected are removed by performing, on the ions captured in the ion trap, an ion-discharging operation in which a portion of the ions are discharged by using a resonant excitation using an excitation voltage having a predetermined single frequency for oscillating the ions in a second direction different from the first direction, where the two steps are performed in this order, in a reverse order or simultaneously.

3. The ion selection method in an ion trap according to claim 1, wherein, in advance of the low-mass side ion isolation step and the high-mass side ion isolation step:

a rough isolation step is performed in which ions having a wide range of mass-to-charge ratios including the specific mass-to-charge ratio or the specific range of mass-to-charge ratios to be selected are selectively left within the ion trap while other unnecessary ions are removed, after which the low-mass side ion isolation step in which ions having mass-to-charge ratios lower than the specific mass-to-charge ratio or the specific range of mass-to-charge ratios to be selected are removed with a separating power higher than in the rough isolation step, and the high-mass side ion isolation step in which ions having mass-to-charge ratios higher than the specific mass-to-charge ratio or the specific range of mass-to-charge ratios to be selected are removed with a separating power higher than in the rough isolation step, are performed on the ions remaining after ion selection by the rough isolation step.

4. An ion trap system having three or more electrodes, comprising:

a) a voltage generator for applying a predetermined voltage to each of the three or more electrodes; and b) a controller for controlling the voltage generated by the voltage generator so as to perform two ion-discharging operations when various kinds of ions are captured in an ion trap, the two ion-discharging operations including: an ion-discharging operation in which a portion of the ions are discharged by shifting a position of a working line on a stability diagram based on a Mathieu equation and thereby changing a lower limit mass that can be captured, so as to remove unnecessary ions having mass-to-charge ratios lower than a specific mass-to-charge ratio or a specific range of mass-to-charge ratios to be selected; and an ion-discharging operation in which a portion of ions are discharged by using a resonant excitation so as to remove unnecessary ions having mass-to-charge ratios higher than the specific mass-to-charge ratio or the specific range of mass-to-charge ratios to be selected, where the two ion-discharging operations are performed in this order, in a reverse order or simultaneously.

5. An ion trap system having three or more electrodes, comprising:

a) a voltage generator for applying a predetermined voltage to each of the three or more electrodes; and b) a controller for controlling the voltage generated by the voltage generator so as to perform two ion-discharging operations when various kinds of ions are captured in an ion trap, the two ion-discharging operations including: an ion-discharging operation for discharging a portion of the ions by using a resonant excitation using an excitation voltage having a predetermined single frequency for oscillating the ions in a first direction so as to remove unnecessary ions having mass-to-charge ratios lower than a specific mass-to-charge ratio or a specific range of mass-to-charge ratios to be selected; and an ion-discharging operation for discharging a portion of the ions by using a resonant excitation using an excitation voltage having a predetermined single frequency for oscillating the ions in a second direction different from the first direction so as to remove unnecessary ions having mass-to-charge ratios higher than the specific mass-to-charge ratio or the specific range of mass-to-charge ratios to be selected, where the two ion-discharging operations are performed in this order, in a reverse order or simultaneously.

6. The ion trap system according to claim 4, wherein:

the controller is configured to control the voltage generated by the voltage generator so as to perform a rough isolation in which ions having a wide range of mass-to-charge ratios including a specific mass-to-charge ratio or a specific range of mass-to-charge ratios to be selected are selectively left within the ion trap while other unnecessary ions are removed, and to subsequently remove, from the ions remaining after the ion selection by the rough isolation, ions having mass-to-charge ratios lower than the specific mass-to-charge ratio or the specific range of mass-to-charge ratios to be selected, with a separating power higher than in the rough isolation, as well as to remove ions having mass-to-charge ratios higher than the specific mass-to-charge ratio or the specific range of mass-to-charge ratios to be selected, with a separating power higher than in the rough isolation.

7. The ion trap system according to claim 4, wherein:

the ion trap system is a digital drive ion trap using a rectangular voltage applied to at least one of the electrodes so as to create an ion-capturing electric field; and the ion trap system changes a duty ratio of the rectangular voltage so as to discharge the portion of the ions by shifting the position of the working line on the stability diagram and thereby changing the lower limit mass that can be captured.

8. The ion selection method in an ion trap according to claim 2, wherein, in advance of the low-mass side ion isolation step and the high-mass side ion isolation step:

a rough isolation step is performed in which ions having a wide range of mass-to-charge ratios including the specific mass-to-charge ratio or the specific range of mass-to-charge ratios to be selected are selectively left within the ion trap while other unnecessary ions are removed, after which the low-mass side ion isolation step in which ions having mass-to-charge ratios lower than the specific mass-to-charge ratio or the specific range of mass-to-charge ratios to be selected are removed with a separating power higher than in the rough isolation step, and the high-mass side ion isolation step in which ions having mass-to-charge ratios higher than the specific mass-to-charge ratio or the specific range of mass-to-charge ratios to be selected are removed with a separating power higher than in the rough isolation step, are performed on the ions remaining after ion selection by the rough isolation step.

9. The ion trap system according to claim 5, wherein:

the controller is configured to control the voltage generated by the voltage generator so as to perform a rough isolation in which ions having a wide range of mass-to-charge ratios including a specific mass-to-charge ratio or a specific range of mass-to-charge ratios to be selected are selectively left within the ion trap while other unnecessary ions are removed, and to subsequently remove, from the ions remaining after the ion selection by the rough isolation, ions having mass-to-charge ratios lower than the specific mass-to-charge ratio or the specific range of mass-to-charge ratios to be selected, with a separating power higher than in the rough isolation, as well as to remove ions having mass-to-charge ratios higher than the specific mass-to-charge ratio or the specific range of mass-to-charge ratios to be selected, with a separating power higher than in the rough isolation.

* * * * *